US007805889B2

(12) United States Patent
Barnett

(10) Patent No.: US 7,805,889 B2
(45) Date of Patent: Oct. 5, 2010

(54) WATER FLOW CONTROLLER AND DEBRIS SEPARATOR FOR ROOF VALLEYS

(76) Inventor: O. Lynn Barnett, 1300 Maple Grove Cir., Clinton, OH (US) 44216

( * ) Notice: Subject to any disclaimer, the term of this patent is extended or adjusted under 35 U.S.C. 154(b) by 0 days.

(21) Appl. No.: 12/207,832

(22) Filed: Sep. 10, 2008

(65) Prior Publication Data

US 2009/0000210 A1 Jan. 1, 2009

Related U.S. Application Data

(63) Continuation-in-part of application No. 11/243,586, filed on Oct. 5, 2005, now abandoned.

(60) Provisional application No. 60/616,303, filed on Oct. 5, 2004.

(51) Int. Cl.
*E04D 13/00* (2006.01)
*E04B 1/00* (2006.01)

(52) U.S. Cl. ..... 52/12; 52/13; 52/746.11

(58) Field of Classification Search ..... 52/11, 52/13, 14, 15, 97, 746.11; 248/48.1
See application file for complete search history.

(56) References Cited

U.S. PATENT DOCUMENTS 1,986,383 A 1/1935 Usinger
2,120,395 A * 6/1938 Dean ..... 210/474
2,271,081 A 1/1942 Layton
2,537,243 A 1/1951 Swartz
3,264,790 A * 8/1966 Beals ..... 52/14
3,874,138 A * 4/1975 Storch ..... 52/199
3,950,951 A * 4/1976 Zukauskas ..... 405/119
4,411,110 A * 10/1983 Carey ..... 52/11
4,418,504 A 12/1983 Lassiter
4,467,570 A 8/1984 Kriegel
4,615,153 A * 10/1986 Carey ..... 52/12
4,616,450 A 10/1986 Shouse
4,631,875 A * 12/1986 Olson ..... 52/12

(Continued)

FOREIGN PATENT DOCUMENTS

DE 3838919 A1 * 5/1989

(Continued)

*Primary Examiner*—Brian E Glessner
*Assistant Examiner*—Adriana Figueroa
(74) *Attorney, Agent, or Firm*—D. A. Stauffer, Reg. Patent Agent

(57) ABSTRACT

Apparatus and method for controlling flow of water from a roof valley into guttering comprising: a generally rectangular, generally planar piece of stock material having two substantially parallel side edges, a back end edge and a right-angle V-shaped front edge, an area of the material that is perforated with a plurality of open slots for allowing rainwater but not debris therethrough; and a front wall that extends downward at the front edge. Sidewalls with vertical slits extend downward at the side edges for raising the stock material above the roof surfaces. Pleats in the front wall enable a preferred installation method that laterally curves the stock material, depressing a longitudinal centerline below the side edges. The method further includes trimming the sidewalls to decrease in height front to back to allow inserting the back end under singles, and securing the front wall within an outward wall of the guttering.

21 Claims, 10 Drawing Sheets

U.S. PATENT DOCUMENTS

| | | | | | |
|---|---|---|---|---|---|
| 4,796,390 | A | | 1/1989 | Demartini | |
| 4,876,827 | A | | 10/1989 | Williams | |
| 5,189,849 | A | | 3/1993 | Collins | |
| 5,251,410 | A | | 10/1993 | Carey | |
| 5,271,191 | A | | 12/1993 | Vahamaki | |
| 5,333,419 | A | | 8/1994 | Hickner | |
| 5,383,310 | A | | 1/1995 | Sapia | |
| 5,471,798 | A | * | 12/1995 | Kuhns | 52/12 |
| 5,495,694 | A | | 3/1996 | Kuhns | |
| 5,557,891 | A | | 9/1996 | Albracht | |
| 5,623,787 | A | * | 4/1997 | Ali | 52/13 |
| 5,630,752 | A | * | 5/1997 | Gubash | 454/366 |
| 5,640,809 | A | | 6/1997 | Iannelli | |
| 5,660,001 | A | | 8/1997 | Albracht | |
| 5,737,879 | A | | 4/1998 | Sweet | |
| 5,772,502 | A | * | 6/1998 | Smith | 454/365 |
| 5,966,875 | A | | 10/1999 | Kuhns | |
| D416,079 | S | | 11/1999 | Hallett, II | |
| 6,009,672 | A | | 1/2000 | Kuhns | |
| 6,016,631 | A | * | 1/2000 | Lowrie, III | 52/12 |
| 6,073,398 | A | | 6/2000 | Williams | |
| 6,151,837 | A | | 11/2000 | Ealer, Sr. | |
| 6,256,933 | B1 | * | 7/2001 | Kuhns | 52/13 |
| 6,371,847 | B2 | * | 4/2002 | Headrick | 454/365 |
| 6,412,229 | B2 | * | 7/2002 | Kuhns | 52/13 |
| 6,584,733 | B2 | | 7/2003 | Wade | |
| 6,681,530 | B1 | * | 1/2004 | Givens | 52/58 |
| 6,883,760 | B2 | | 4/2005 | Seise, Jr. | |
| 6,904,718 | B2 | * | 6/2005 | Fox | 52/12 |
| 2002/0124476 | A1 | | 9/2002 | Iannelli | |
| 2003/0159365 | A1 | * | 8/2003 | Hutton | 52/13 |
| 2004/0244302 | A1 | * | 12/2004 | Neumann | 52/11 |
| 2004/0255522 | A1 | * | 12/2004 | Knudson et al. | 52/11 |
| 2005/0150174 | A1 | * | 7/2005 | Eilbacher | 52/11 |
| 2006/0048456 | A1 | | 3/2006 | Iannelli | |
| 2007/0209289 | A1 | * | 9/2007 | Garcia | 52/11 |
| 2009/0107053 | A1 | * | 4/2009 | Guilford | 52/12 |

FOREIGN PATENT DOCUMENTS

| | | | |
|---|---|---|---|
| JP | 06073849 | A * | 3/1994 |

* cited by examiner

WATER FLOW CONTROLLER AND DEBRIS SEPARATOR FOR ROOF VALLEYS

CROSS-REFERENCE TO RELATED APPLICATIONS

This is a continuation-in-part of U.S. patent application Ser. No. 11/243,586 filed Oct. 5, 2005 by O. Lynn Barnett ("parent application"), which claims the benefit of U.S. Provisional Patent Application No. 60/616,303, filed Oct. 5, 2004 by O. Lynn Barnett, the entirety of which is incorporated by reference herein.

TECHNICAL FIELD OF THE INVENTION

The present invention relates to apparatus used in conjunction with roof valleys, and methods of using the apparatus to control flow of rain water from the roof valley into rain gutters at the edge of the roof, and wherein the apparatus also separates debris from the water to enable unobstructed water flow.

BACKGROUND OF THE INVENTION

It is well known that open trough roof gutters fill with leaves and other debris causing impaired effectiveness of the gutter as a roof drainage system. Frequently, water accumulates in clogged gutters causing an overflow failure which can damage the building. If the gutters freeze, the expanding water can deform the gutter and may cause it to pull away from the building support. The water may also force its way back up under the shingles or roof covering, causing damage to the roof itself. Thus some form of gutter shield is desirable for separating (straining) debris from the water running off of a roof edge. Ideally, such a shield will not only allow, but encourage water to flow into the gutter while debris is separated and enabled to slide off the outer edge of the shielded gutter.

Some known gutter shields are formed of screen material (e.g., hardware cloth), or expanded metal screening in which a web of metal stock is slit and then drawn or expanded so as to laterally stretch open the slits to form openings for water and yet at the same time to shield the gutter from debris. Such systems, while somewhat effective in guarding against accumulation of larger debris (e.g., twigs and leaves) in the gutters, have openings which are large enough to allow smaller items of debris (e.g., small seeds, "propeller" vanes on seed pods, evergreen "needles" and leaf fragments) to pass through either partly or entirely. If not removed, these materials accumulate and eventually clog the shield and/or the gutter.

Prior art gutter shields that, like the above-described screening, have a rather rough surface texture can become externally clogged because such arrangements allow debris to accumulate on the shield itself thereby blocking water's access to the gutter and rendering it ineffective. In such cases, water can well up about the accumulated debris and migrate under the edge of the roof and/or roof covering causing damage.

U.S. Pat. No. 6,073,398 (Williams; 2000) discloses a gutter cover with a planar back area (14) connected to a curved front portion (18) that leads water by capillary action into the covered gutter. It can be seen that debris (at least larger pieces) generally will not follow the curved portion and will instead wash off the outside edge of the covered gutter. Other examples of capillary action shields with gutter access holes beyond a curved portion include U.S. Pat. No. 5,251,410 (Carey; 1993) and U.S. Pat. No. 4,616,450 (Shouse; 1986).

A problem with designs such as Williams '398, Carey '410, and Shouse '450 is that in a hard rain, water flow is too great and a significant portion of the water will simply shoot outward beyond the outside edge of the covered gutter. In order to address this problem, gutter shields such as those disclosed in U.S. Pat. No. 5,640,809 (Iannelli; 1997) and U.S. Pat. No. 5,557,891 (Albracht; 1996) provide means for slowing down the flow of water. Iannelli '809 provides a substantially planar primary surface (20) that has longitudinal protuberances (35) and a rise (36); and Albracht '891 has a relatively wide horizontal portion (7).

There are also problems with gutter shields that are secured horizontally across the top opening of the gutter, or which have substantially planar or wide horizontal portions. Since debris may not be washed off of such horizontal portions, the weight of accumulated debris on the gutter, which bears the weight of the shield as well as the debris accumulated thereon, can cause the gutter or the shield to collapse and/or pull away from the fascia to which it is attached. Thus, the shield may create more problems than it solves. There is therefore a need for a gutter shield that is effective in preventing the accumulation of debris both in and on top of a gutter, and that allows the debris to fall away or be swept off of the shield by wind and rain.

The prior art contains a number of gutter shields that are sloped downward and outward and which have apertures through the downslope for separating water from debris. The optimum shape of the shield material around and leading into each aperture, and therefore the size, shape and location of an aperture, is the subject of much debate and is often a factor in distinguishing one shield from another. These shapes, etc. affect the water's flow rate, capillary action and sheeting, as well as the size/shape of debris that is filtered out and whether the debris will accumulate on the shield and/or clog its apertures.

Capillary action and sheeting are both effects of surface tension but may effectively work against each other. For example, capillary action results in water being "held" against a surface and "pulled" through an aperture toward which and/or through which the surface leads the water. In opposition to this, water may pass over an aperture if the water is held together by surface tension in a continuous "sheet". Such a sheet must be effectively broken or perforated in order for any of the water to drain away into an aperture below the sheet. It is also possible for a sheet of water to form on the underside of a sloped surface, thereby forming a barrier to water flow down through the sheet from apertures above it.

U.S. Pat. No. 4,418,504 (Lassiter; 1983) discloses a sloped shield having apertures (19) that are positioned between an upstream arch followed by a trough. U.S. Pat. No. 6,016,631 (Lowrie, III; 2000) discloses a gutter device having a plurality of holes (31), preferably formed by creating a depression (31) in the downslope portion. U.S. Pat. No. 5,271,191 (Vahamaki; 1993) discloses a gutter shield having slotted (24) vanes (26) wherein the vanes are sloped downward at a vane angle (27) relative to the plane of the shield's stock material. U.S. Pat. No. 6,151,837 (Ealer, Sr.; 2000) discloses a perforated sheet gutter screen comprising a sheet metal member with a generally smooth top surface and a plurality of channels (54) and slots (56), wherein each channel extends downward and away from the top surface and has a lower end that defines a lower portion of the periphery of one of the slots, and has a concave profile such that an upper, leading edge of the channel is curved substantially along its full length.

In light of the abovedescribed problems and defects in the prior art, it is an object of the present invention to overcome these defects by providing a gutter shield that not only separates even small debris from rainwater, but furthermore resists accumulation of the debris on the gutter shield, and even further encourages the flow of water through the shield and into the shielded gutter even when water is flowing rapidly and tending to "sheet" above and/or below the shield.

Controlling water flow (down the roof, into the gutter) and preventing debris accumulation can be particularly challenging in a roof valley area. There may be increased water flow in the valley (two surfaces are dumping water into the valley, as opposed to only one). Also, with two surfaces joining one another, the structural/geometric variations can be significant, as contrasted with a simple single roof surface sloping into a gutter section.

U.S. Pat. No. 1,986,383 (Usinger; 1935) discloses a gutter miter for carrying a gutter or eaves trough into an angle formed by roof sections. The gutter miter is constructed to promote distribution of the water from the valley to the gutters provided for the roof sections. Two roof sections (a) meet at an angle and are provided with a valley gutter (b).

U.S. Pat. No. 6,883,760 (Seise; 2005) discloses a rain gutter cover system (10). The system (10) is configured for directably collecting rain water running off of the roof (R) of a building (B) while substantially preventing undesired debris from entering the gutter (16). The system (10) broadly includes a gutter assembly (12) and a cover assembly (14) coupled to, and covering, the gutter assembly (12). The cover assembly (14) includes a one piece screen (20) and a plurality of fluted perforations (22) formed in the screen (20). The fluted perforations (22) are each particularly configured to draw water through the screen (20) without allowing undesired debris through the screen (20) and each includes a channel (40) recessed into the screen (20) and a corresponding hole (42) defined in the downhill end of the channel (40). The screen (20) is generally S-shaped and defines an upper guard section (24), a bull-nose ledge (26), an intermediate siphoning section (28), a secondary bend (30), and a lower drainage section (32). A valley segment (210) of the system is also disclosed and includes a plurality of bull-nose ledges (212, 214, 216, 218 and 220), each guarding a plurality of fluted perforations (222) along the valley of a roof. An alternative valley configuration is also disclosed: The rain gutter cover system (300) utilizes a generally flat valley segment (302) with a single bull-nose ledge (304) at the gutter. The segment (302) includes a plurality of fluted perforations (306) that siphon water through the screen (302) and onto the valley flashing below. Unlike the corner gutter assembly (202), the gutter assembly (308) includes an angled miter-boxed corner (310) that provides increased space between the fascia board and an outermost gutter edge (312) for positioning the bull-nose ledge (304).

U.S. Pat. No. 5,623,787 (Ali; 1997) discloses a resilient mesh elongated guard for the valley between adjoining angled sections of a tile roof wherein the guard is bent into a convex shape and positioned into the valley with the lateral edges of the guard engaging the sides of the opposed faces of the tile.

Glossary & Definitions

Unless otherwise noted, or as may be evident from the context of their usage, any terms, abbreviations, acronyms or scientific symbols and notations used herein are to be given their ordinary meaning in the technical discipline to which the disclosure most nearly pertains. The following terms, abbreviations and acronyms may be used throughout the descriptions presented herein and should generally be given the following meaning unless contradicted or elaborated upon by other descriptions set forth herein. Some of the terms set forth below may be registered trademarks (®).

Dormer A vertical window built into the slope of a pitched roof.

Eaves The area just below the lower end of the roof—includes the fascia, soffit and guttering.

Fascia The vertical board secured to the ends of the rafters under the lower end of the roof to which the guttering is normally fixed—traditionally timber, nowadays usually uPVC.

Flat Roof A roof which has negligible slope, usually covered in felt, metal, or other material which is impermeable to water.

Gable The vertical wall at the end of a pitched roof, an inverted 'V'.

Gable Roof A gable (or gabled) roof is a triangular roof, with flat (vertical) ends.

Gutter A rain gutter (also known as eaves trough, guttering or just gutter) is a narrow channel, or trough, forming the component of a roof system which collects and diverts rainwater shed by the roof. In many buildings, the purpose of this diversion is to prevent water from falling off the roof edges. This uncontrolled water can cause structural damage to the walls and/or the foundation of a building. Another purpose of rain guttering can be to harvest rainwater for household or garden use.

Rain gutter can be constructed from a variety of materials, including galvanized steel, painted steel, copper, painted aluminum (also known as Seamless Aluminum), PVC (and other plastics), concrete, stone and wood.

Water collected by a rain gutter is fed, usually via a downpipe, into a collection system. A collection system can be either a rainwater tank, a storm water main, or a sewer main (depending upon local codes). In some locations where collection to a main is not feasible, the water is dispersed into a storm water pit or cistern. The rain gutter on houses that have overhanging trees can become blocked with leaves over time and can cause a fire hazard, particularly in bushfire areas. Various styles of mesh and other perforated materials have been applied as leaf guard to help prevent this problem from occurring. In some areas with high bushfire danger, some type of leaf guard is mandated by the building code.

Clogged gutters can cause water leakage into the house as the water backs up. Clogged gutters can also lead to stagnant water build up which allows mosquitoes to breed and also allow grasses and weeds to grow in the gutter.

Gutters in colder climates also suffer the effects of freezing. However this can be mitigated through the use of heating cables placed in the trays that become activated in freezing weather.

Hip A sloping ridge formed by the junction of a pitched roof and a hip end.

Hipped Roof A hip (or hipped) roof is a type of roof where all sides are sloped

Lap Joint In woodworking, or metal fitting, a lap joint describes a technique for joining two pieces of material by overlapping them. A lap may be a full lap or half lap. In a full lap, no material is removed from either of the members to be joined, resulting in a joint which is the combined thickness of the two members. In a half lap joint, material is removed from each of the members so that the resulting joint is the thickness of the thickest member. Most commonly in half lap joints, the members are of the same thickness and half the thickness of each is removed.

Ridge The horizontal line at the top of a pitched roof—applies whether there is a sloping roof on both sides (a Duo ridge), or if there is just one (a Mono ridge).

Shingles Roof shingles are a roof covering consisting of individual overlapping elements. These elements are normally flat rectangular shapes that are laid in rows without the side edges overlapping, a double layer is used to ensure a waterproof result. Shingles are laid from the bottom edge of the roof up, with the bottom edge of each row overlapping the previous row by about half its length.

An asphalt shingle is a type of roof shingle. They are one of the most widely used roofing covers due to the fact that they are relatively inexpensive and fairly simple to install. Two types of asphalt shingles are used: organic and fiberglass or glass fiber. Organic shingles are generally paper (felt) saturated with asphalt to make it waterproof, then a top coating of adhesive asphalt is applied and the ceramic granules are then embedded. A portion of the granules contain leachable copper or more often tin to prevent moss growth on the roof. Organic shingles contain around 40% more asphalt per square (100 sq. ft.) than fiberglass shingles which makes them weigh more and gives them excellent durability and blow-off resistance. Shingles are judged by weight per square.

Fiberglass shingles have a glass fiber reinforcing mat manufactured to the shape of the shingle. The mat is then coated with asphalt which contains mineral fillers. The glass fiber mat is not waterproof by itself and is a wet laid fiberglass mat bonded with urea-formaldehyde resin. It's used for reinforcement. The asphalt makes the fiberglass shingle waterproof.

Shingles have been made of various materials such as wood shingle, slate shingle, asbestos-cement, bitumen-soaked paper covered with aggregate (asphalt shingle) or ceramic.

Soffit The horizontal board used to seal the space between the back of the fascia and the wall of the building—traditionally timber, or cement board—nowadays usually uPVC with air vents.

Valley The internal angle formed where adjacent pitched roofs meet. Traditionally zinc, lead, tin, or galvanized sheeting was formed on site to create a water channel downwards, nowadays pre-shaped valley channels are available. The shape may be a simple V following the roof lines, or may have a secondary ridge (e.g., inverted V) running along the centerline of the valley. A "laced" valley covering utilizes reasonably flexible shingles (e.g., asphalt) to form the water channel by interleaving rows of shingles so that they overlap. For example, the first row of shingles on the right will be laid across the valley to end 12 inches to the left of the valley centerline. Then the first row of shingles on the left will be laid across the valley, and over the right-hand end shingle, to end 12 inches to the right of the valley centerline. The second and subsequent rows are laid the same way. Thus each subsequent right-hand row end will overlap the previous left-hand row end when it crosses the valley centerline, and each left-hand row end will overlap the right-hand row end of the corresponding row.

Verge The wall (or rafter) under the edge of a roof where it tops a gable end. The sides of the tiles down the verge were traditionally cemented, nowadays closing strips are available.

BRIEF SUMMARY OF THE INVENTION

Summary of the Parent Application

A gutter shield is disclosed for separating debris from water entering a gutter, the shield being intended for installation over a conventional longitudinally extending gutter that is mounted outboard from and below a longitudinally extending roof edge, the gutter shield comprising: a longitudinally extending length of planar stock material that is perforated by a plurality of intermittent, longitudinally extending slots, each slot being at the outboard edge of a tab that ramps downward and outward from a top surface of the stock material; and a longitudinally extending ridge extending downward from an underside of the shield for the purpose of breaking up water sheeting along the underside of the shield.

The gutter shield is characterized in that the ridge extends downward at a sharp angle from the underside of the shield between laterally adjacent tabs.

The gutter shield is characterized in that the ridge is an elongated outboard end of a tab such that the tab end is extended outward past the slot associated with the tab.

The gutter shield is characterized in that the elongated outboard end of the tab extends outward and downward in the same plane as the part of the tab that passes under an outboard slot edge. Alternatively, the elongated outboard end of the tab curls outward and downward with the tightest curvature being after the tab passes under an outboard slot edge. Preferably the tab has an elliptical profile starting with a gradual, smoothly curving bend shape at an inboard tab bent edge.

The gutter shield is characterized in that the ridge extends downward at a sharp angle from the underside of a tab portion of the shield.

The gutter shield further comprises a gradual, smoothly curving bend shape at an inboard bent edge of the tab.

The gutter shield further comprises a shallow angle of approximately 15 to 45 degrees between a planar portion of the tab and the shield surface.

The gutter shield further comprises a fastening flange that is at an outboard lateral edge of the gutter shield and is offset slightly upward from the plane of the gutter shield, for fastening the gutter shield to the gutter with the majority of the outboard lateral edge being underneath a gutter marginal edge.

The gutter shield is characterized in that the ridge is a fold in the stock material.

A method is disclosed for encouraging water to flow rapidly into a conventional gutter that is covered by a gutter shield for separating debris from the water, wherein the gutter shield comprises a longitudinally extending length of planar stock material, and the method comprises the steps of: perforating the stock material with a plurality of intermittent, longitudinally extending slots, each slot being at the outboard edge of a tab that ramps downward and outward from a top surface of the stock material; and breaking up water sheeting along the underside of the shield by providing a longitudinally extending ridge that extends downward from an underside of the shield.

The method further comprises the step of extending the ridge downward at a sharp angle from the underside of the shield between laterally adjacent tabs.

The method further comprises the step of providing the ridge on a tab by elongating an outboard end of the tab such that the tab end is extended outward past the slot associated with the tab. A further step comprises using the ridge to also entrain water flowing off the end of the tab by extending the tab outward and downward in the same plane as the part of the tab that passes under an outboard slot edge. Alternatively, a further step comprises using the ridge to also entrain water flowing off the end of the tab by curling the tab outward and downward with the tightest curvature being after the tab passes under an outboard slot edge. An additional step comprises curling the tab along an elliptical profile starting with a gradual, smoothly curving bend shape at an inboard tab bent edge.

The method further comprises the step of encouraging capillary action in opposition to water sheeting on the top surface by gradually and smoothly curving the bend at an inboard bent edge of the tab.

The method further comprises the step of providing a shallow angle of approximately 15 to 45 degrees between a planar portion of the tab and the shield surface.

The method further comprises the step of fastening the gutter shield to the gutter such that the majority of the outboard lateral edge lies underneath a gutter marginal edge.

Summary of the Present Application

The present invention extends water flow control and debris separation concepts from the gutter shield uses of the parent application to water flow control and debris separation applied to roof valleys and other roof-to-gutter transitions wherein water flow down the roof is concentrated in a higher volume flow than the rest of the roof. Thus:

According to the invention a flow controller apparatus is disclosed for controlling flow of water from a roof valley into guttering that is mounted at the front edge of the roof, the apparatus comprising: a generally rectangular, generally planar piece of stock material having two longitudinally extending side edges and a longitudinal axis therebetween, a back end edge and a front end edge, a top surface and a bottom surface; an area of the stock material that is perforated with a plurality of open holes for allowing rainwater therethrough; a lateral curve in the stock material wherein the top surface is depressed along the longitudinal axis to make it lower than the side edges; and a front wall that extends downward from the bottom surface of the stock material along the front end edge.

Preferably the open holes further comprise lateral slots that are spaced apart in substantially parallel, laterally-extending rows. Further preferably at least some of the slots each comprise an aperture through the stock material at an outboard edge of a downwardly ramped tab; and/or at least some of the tabs each comprise a breakwall ridge extending downward at an end of the tab.

Further according to the invention, two sidewalls extend downward from the bottom surface of the stock material and comprise: a first sidewall extending downward along a portion of a first of the two side edges of the flow controller; and a second sidewall extending downward along a portion of a second of the two side edges of the flow controller. Preferably each of the sidewalls is segmented by a plurality of vertical slits for allowing water to pass from outside of the flow controller to underneath the planar stock material.

Further according to the invention, the sidewalls decrease in height toward the back end edge. Most preferably the sidewalls are a first height for a frontmost portion of their length; the frontmost portion's length corresponding to the longitudinal distance that the frontmost sidewall portion would extend from an outer upstanding wall of the gutter to the front edge of the roof after being installed; and the height of the sidewalls extending back from the frontmost portion tapers down from a second height that is less than the first height, to zero near the back end edge.

According to the invention at least one vertical pleat is in the front wall, wherein the pleat comprises a portion of the front wall that is expandable substantially laterally or substantially in the plane of a portion of the front wall if that portion is not extending substantially laterally.

Optimally, a first pleat substantially at a longitudinal axis of the flow controller is disposed laterally, approximately midway between the two side edges of the flow controller; a second pleat is disposed substantially on a line parallel to the longitudinal axis and approximately midway between the longitudinal axis and one of the side edges; and a third pleat is disposed substantially on a line parallel to the longitudinal axis and approximately midway between the longitudinal axis and the other one of the side edges.

According to the invention, an embodiment of the invention further comprises first and second front wall portions; the first front wall portion extending downward along a first portion of the front end edge; and the second front wall portion extending downward along a second portion of the front end edge; wherein the front end edge is generally V-shaped, such that the first and second portions of the front end edge meet at an angle which substantially matches a nominal 90-degree angle inside corner formed by two roof front edges in front of a roof valley.

In another embodiment, the apparatus further comprises: an inner wall that extends downward from a bottom surface of the planar stock material; wherein the inner wall: extends laterally between the two side edges; and is disposed substantially at a right angle relative to the longitudinal axis. Preferably at least one vertical pleat is in the inner wall, wherein the pleat comprises a portion of the inner wall that is expandable substantially laterally. Further preferably, the apparatus further comprises: a first pleat substantially at a longitudinal axis of the flow controller disposed laterally approximately midway between the two side edges of the flow controller; a second pleat disposed substantially on a line parallel to the longitudinal axis and approximately midway between the longitudinal axis and one of the side edges; and a third pleat disposed substantially on a line parallel to the longitudinal axis and approximately midway between the longitudinal axis and the other one of the side edges.

According to the invention, the apparatus with the inner wall may further comprise: a scored, perforated, or otherwise weakened line extending laterally and disposed in front of the inner wall, thereby easing removal of wing portions of the flow controller to make the inner wall a front wall.

According to the invention, a method of controlling flow of rainwater from a sloped roof down into guttering at the roof's front edge is disclosed, the method comprising the steps of: providing a generally rectangular, generally planar piece of stock material having two longitudinally extending side edges and a longitudinal axis therebetween, a back end edge and a front end edge, a top surface and a bottom surface, an area of the stock material that is perforated with a plurality of open holes for allowing rainwater therethrough, and a front wall that extends downward from the planar stock material at the front end edge; installing the stock material such that: the side edges extend up the roof surface, at least a portion of the back end edge is secured against the roof, and the front wall extends down into the guttering; and depressing the top surface along the longitudinal axis to make it lower than the side edges for at least a portion of the stock material extending back from the front end edge; and attaching the front wall inside of an outward upstanding wall of the guttering; thereby providing a flow controller with a laterally concave top surface for concentrating the water flow and debris along the longitudinal axis to maximize effectiveness in ejecting debris off of the roof while separating the water from the debris, the water separately passing through the open holes to flow under the stock material until stopped by the front wall and thence being diverted down into the guttering rather than flowing over the top of the guttering.

Preferably the method further comprises the steps of: providing sidewalls extending downward from the side edges of the stock material for raising the stock material above the roof surfaces; providing vertical slits in the sidewalls for allowing water, separated from debris, to pass from beside the flow controller to underneath the planar stock material; and trimming or otherwise adjusting the height of the sidewalls such that they are a first height for a frontmost portion of their length; the frontmost portion's length corresponding to the longitudinal distance that the frontmost sidewall portion would extend from an outer upstanding wall of the gutter to the front edge of the roof after being installed; and such that the height of the sidewalls extending back from the frontmost portion tapers down from a second height that is less than the first height, to zero near the back end edge.

Preferably the method further comprises the step of: providing pleats in the front wall for enabling the front wall to fan as the stock material is depressed, thereby maintaining the front wall as a substantially watertight breakwall even when the stock material is deformed.

Preferably the method further comprises the steps of: installing the stock material along a valley formed by two adjoining roof surfaces such that the front wall extends down into an inside corner of the guttering; and providing a substantially right angled V-shaped front end edge and a corresponding front wall that fits an inside corner of the guttering. Further preferably the method further comprises the steps of: providing a second front wall extending downward from the bottom surface of the planar stock material in a straight lateral line normal to a longitudinal axis of the stock material, and rearward of the V-shaped first front wall; and installing this double-front walled flow controller along a valley according to the method disclosed hereinabove, or, alternatively: cutting off, breaking off, or otherwise removing the first front wall and the planar stock material between it and the second front wall; and installing the flow controller on a portion of the roof that has a laterally straight front edge and correspondingly straight guttering such that the second front wall is the front wall that extends down into the guttering and is attached according to the method(s) of the invention.

According to the invention, a preferred embodiment is conceived as a "kit" that comprises the physical elements of the flow controller apparatus, plus instructions to an installer that explain the action elements of the flow control method according to the invention, particularly regarding installation of the apparatus as a way of completing the inventive shape and positioning of the apparatus for optimal use according to the invention.

Alternatively, the flow apparatus may be provided for installation in a finished form wherein the surface is fixed in a preferred concave shape and is trimmed as described, thereby providing a ready-to-install flow controller, which may be provided in at least two shapes—one with a V-shaped front wall for installing in a roof valley leading down into an inside corner of roof guttering; and one with a laterally straight front wall for installing in the path of a concentrated flow of water leading down into a laterally straight section of guttering.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar or related but modified elements may be referred to with similar numbers in a single drawing. For example, each of a plurality of related elements collectively referred to as 199 may be referred to individually as 199*a*, 199*b*, 199*c*, etc. Or, elements may have the same number but are distinguished by primes. Such relationships, if any, between similar elements in the same or different figures will become apparent throughout the specification, including, if applicable, in the claims and abstract.

Figure 1:
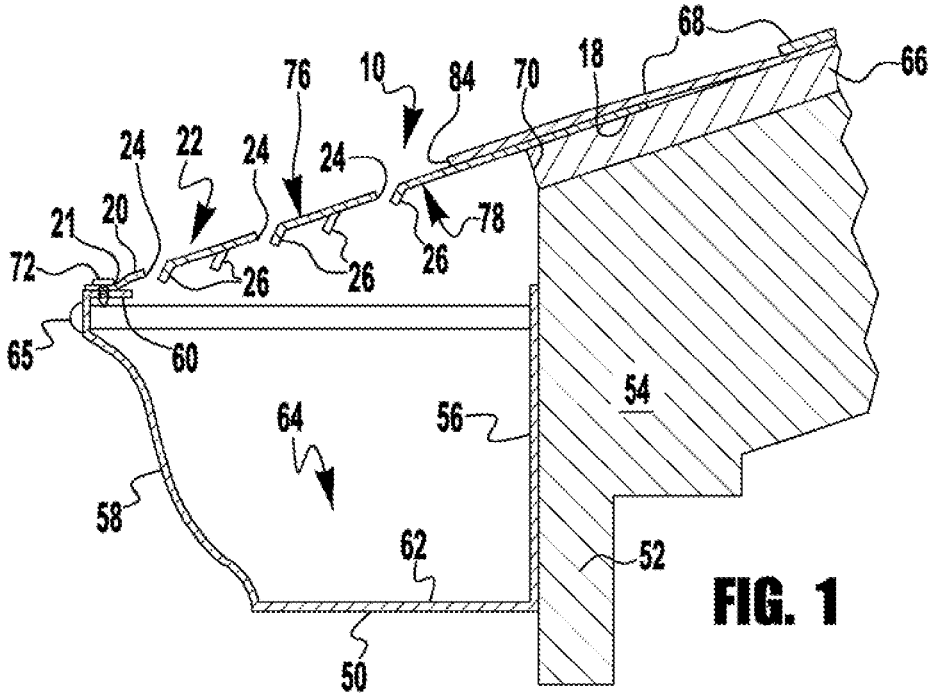
Figure 2A:
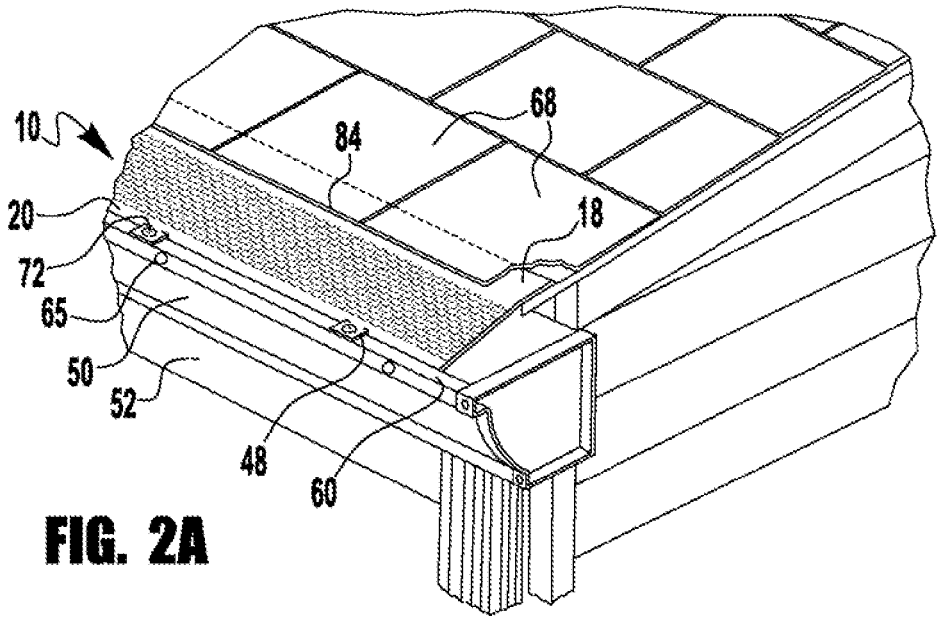
Figure 2B:
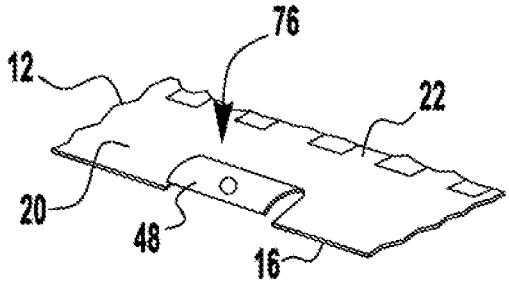
Figure 3:
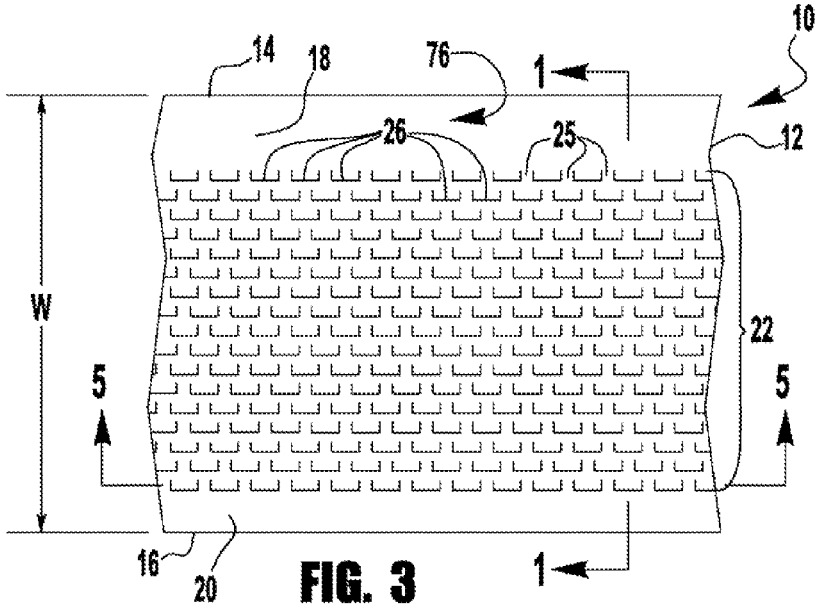
Figure 4:
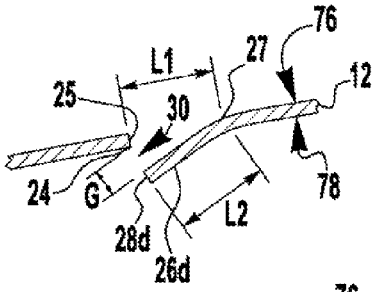
Figure 5A:
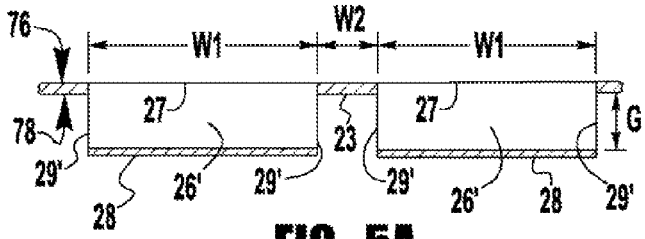
Figure 5B:
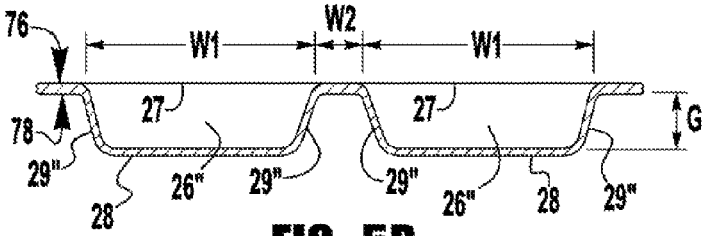
Figure 6A:
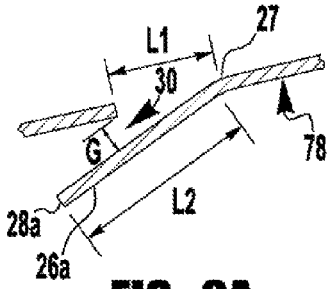
Figure 6B:
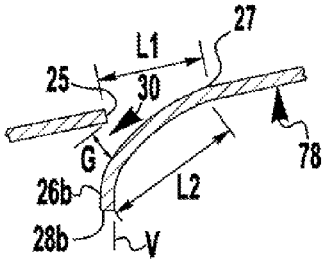
Figure 6C:
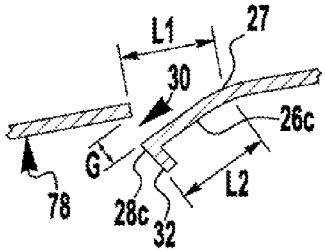
Figure 7:
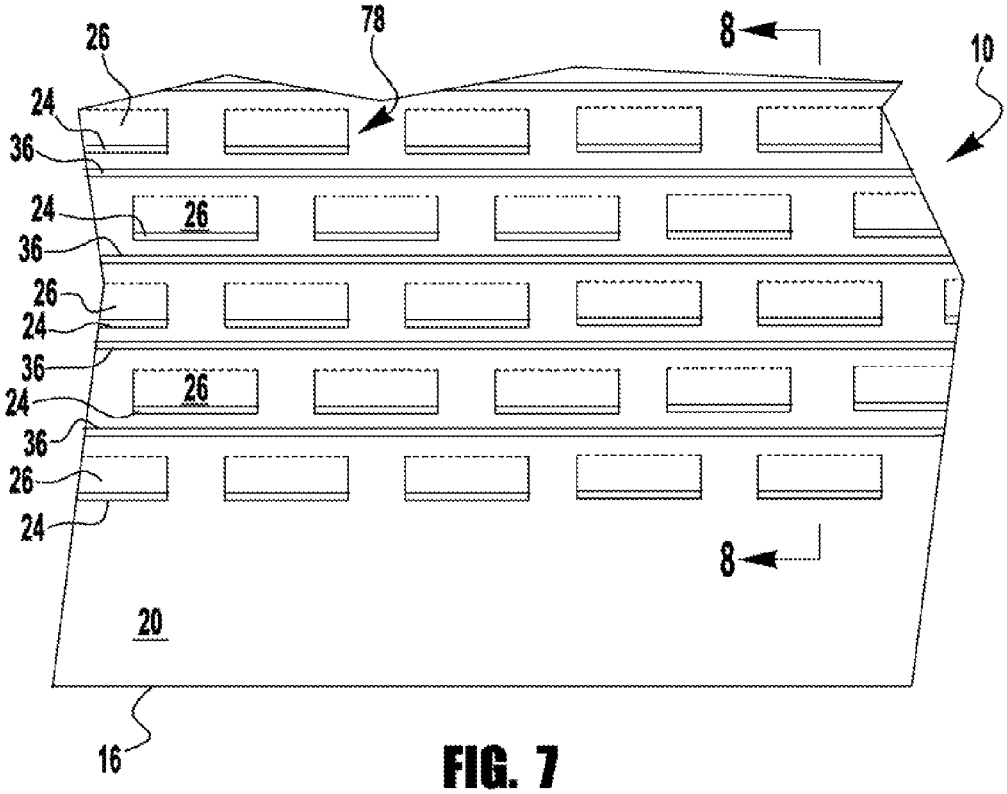
Figure 8:
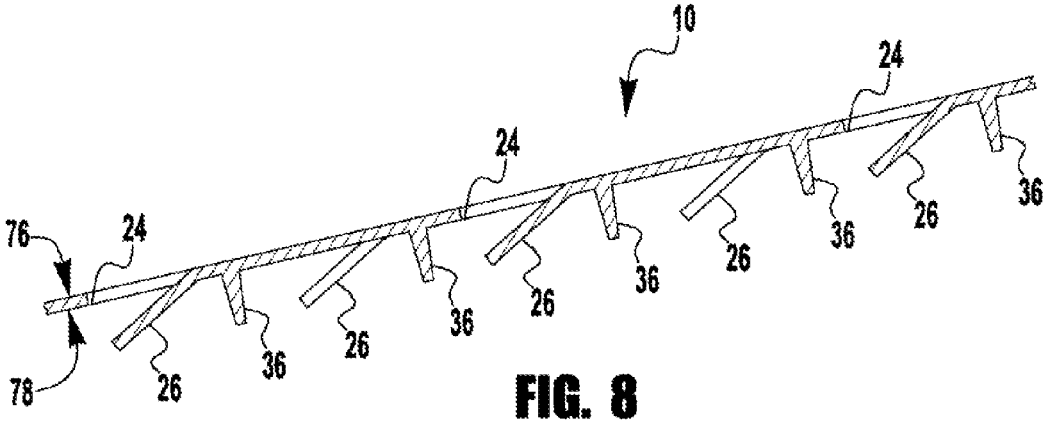

The structure, operation, and advantages of the herein presented embodiment(s) of the invention will become further apparent upon consideration of the following description taken in conjunction with the accompanying drawings, wherein:

FIG. 1 is a side cross-sectional view of a gutter shield installed on a conventional gutter and roof structure, the view of the shield being taken along the line 1-1 shown in FIG. 3, all according to the invention in the parent case;

FIG. 2A is a perspective view of a gutter shield embodiment with fastening flanges used to install the shield on the conventional gutter and roof structure, according to the invention in the parent case;

FIG. 2B is a perspective view of a portion of the gutter shield embodiment with fastening flanges of FIG. 2A, according to the invention in the parent case;

FIG. 3 is a top view of a gutter shield, according to the invention in the parent case;

FIG. 4 is a side cross-sectional view of a tab and slot portion of the gutter shield of FIG. 3, the view being taken along the line 1-1 shown in FIG. 3, wherein the tab is a basic tab embodiment, according to the invention in the parent case;

FIGS. 5A and 5B are edge cross-sectional views of tab and slot portions of a gutter shield, the view being taken along the line 5-5 shown in FIG. 3, wherein alternative embodiments of the tab (cut tab in 5A and formed tab in 5B) are illustrated, according to the invention in the parent case;

FIGS. 6A, 6B, and 6C are side cross-sectional views of a tab and slot portion of the gutter shield of FIG. 3, the view being taken along the line 1-1 shown in FIG. 3, illustrating three alternative tab embodiments (elongated), according to the invention in the parent case;

FIG. 7 is a bottom view of a portion of a gutter shield that has longitudinal ridge-walls, according to the invention in the parent case; and FIG. 8 is a side cross-sectional view of a portion of the gutter shield of FIG. 7, the view being taken along the line 8-8 shown in FIG. 7, according to the invention in the parent case.

Figure 9A:
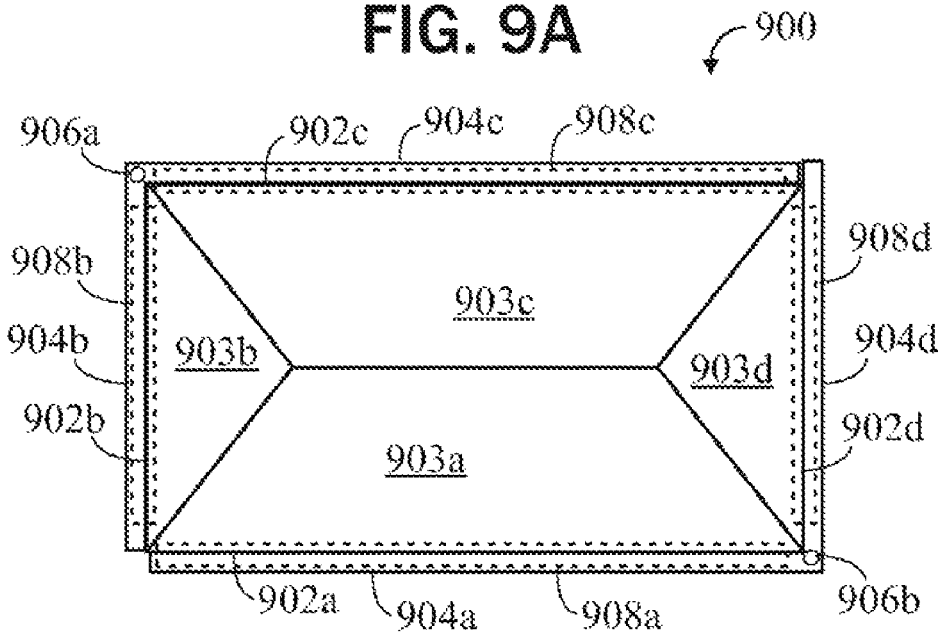

FIG. 9A is a top view of a roof structure, according to the prior art.

Figure 9B:
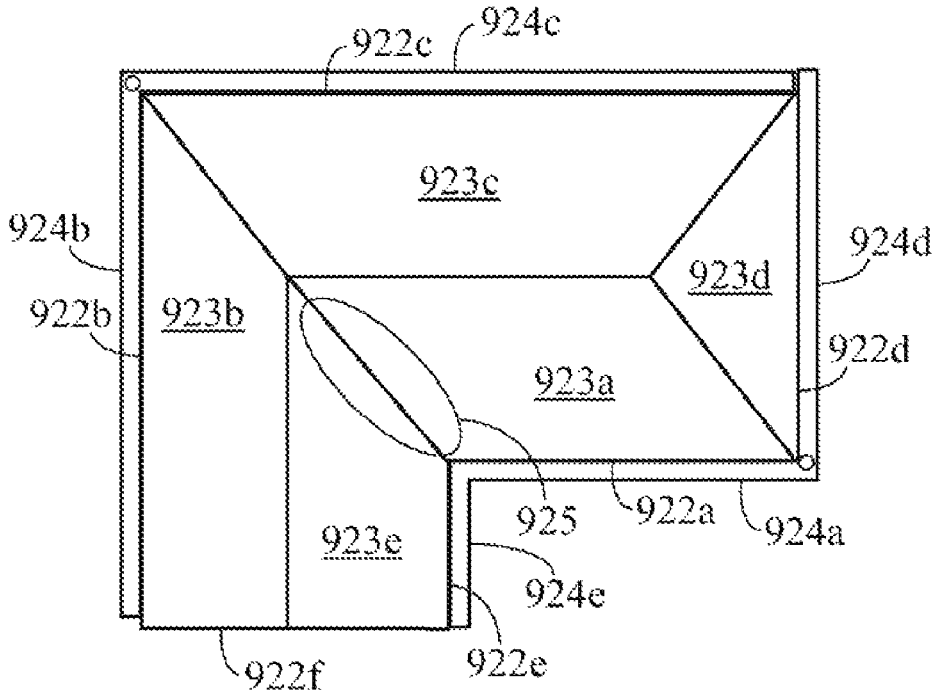

FIG. 9B is a top view of a roof structure having a valley, such as is applicable to the present invention.

Figure 10A:
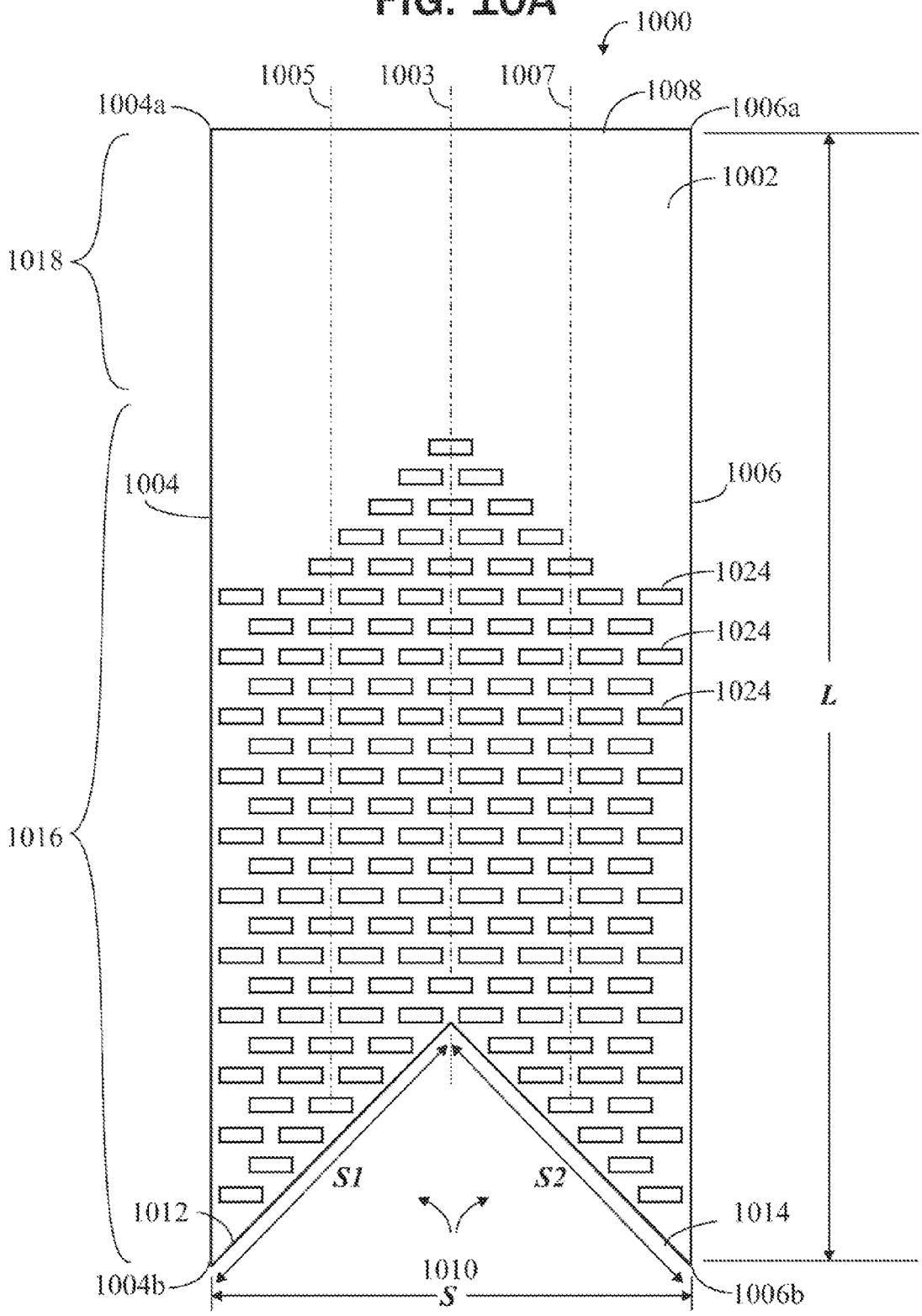

FIG. 10A is a plan view of a flow controller for roof valleys, viewed from a top surface thereof, according to the present invention.

Figure 10B:
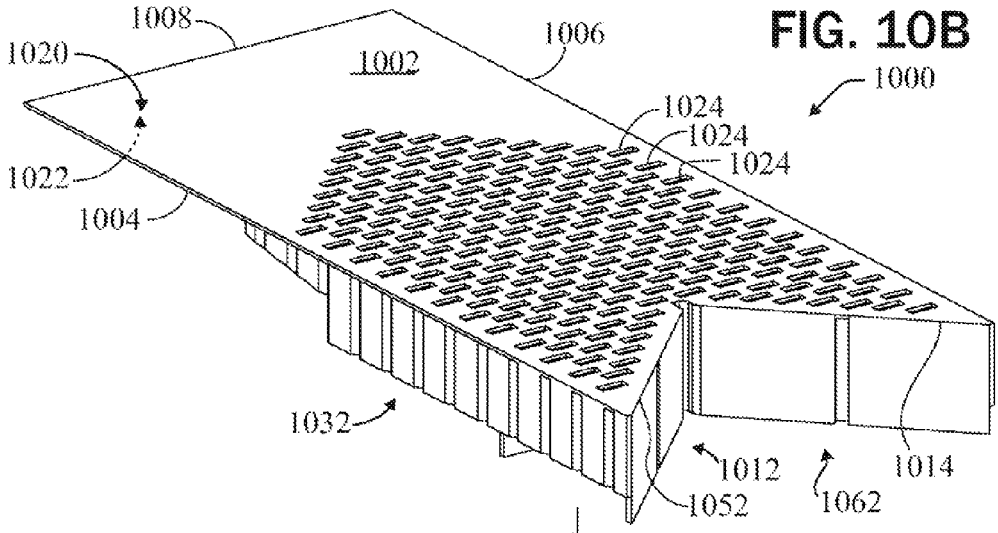

FIG. 10B is a perspective view of a flow controller for roof valleys, viewed from the top/front, according to the present invention.

Figure 10C:
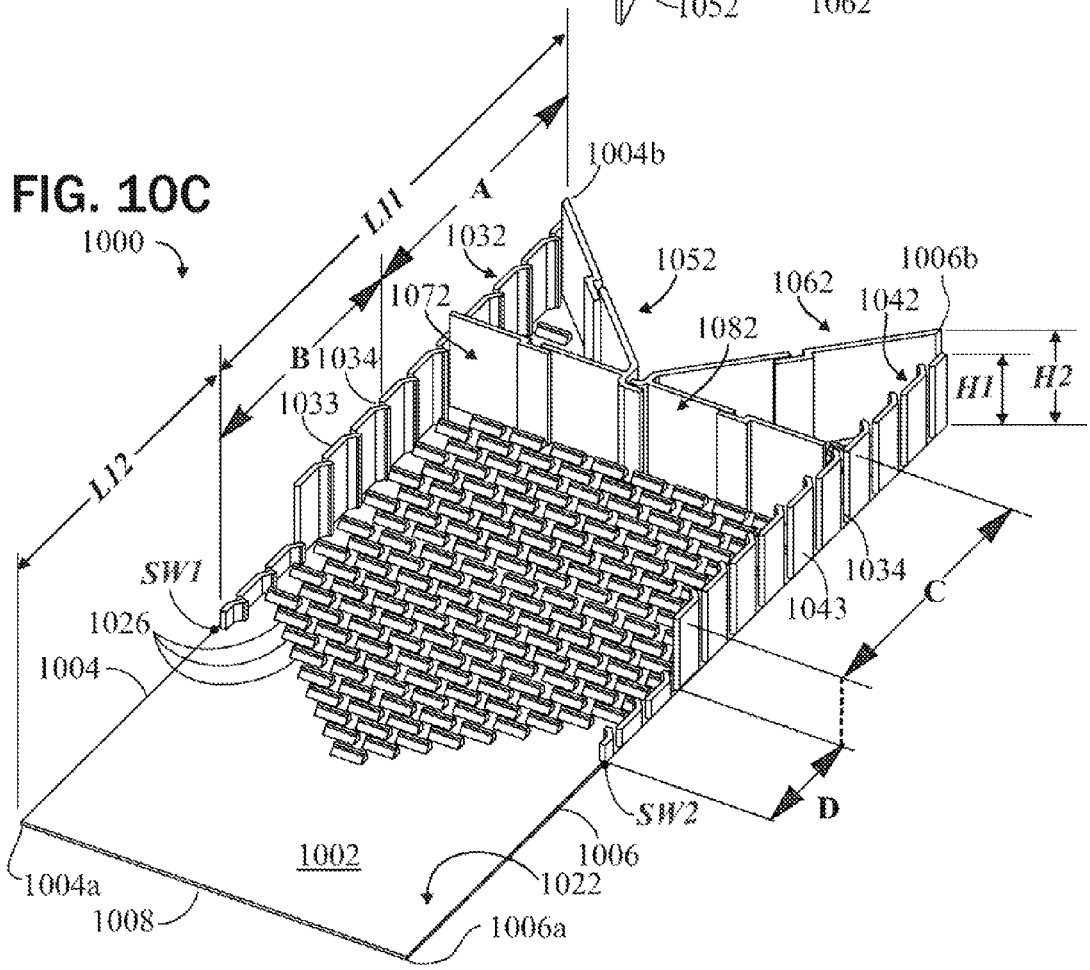

FIG. 10C is a perspective view of a flow controller for roof valleys, viewed from the bottom/front, according to the present invention.

Figure 10D:
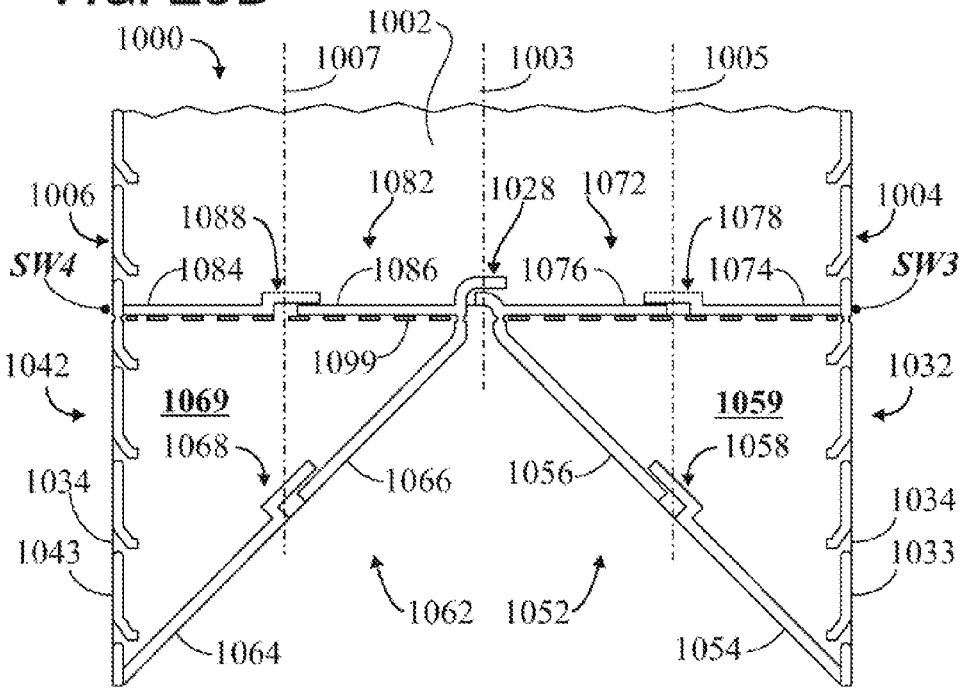

FIG. 10D is a plan view of a portion of the flow controller for roof valleys, viewed from the bottom, according to the present invention.

Figure 10E:
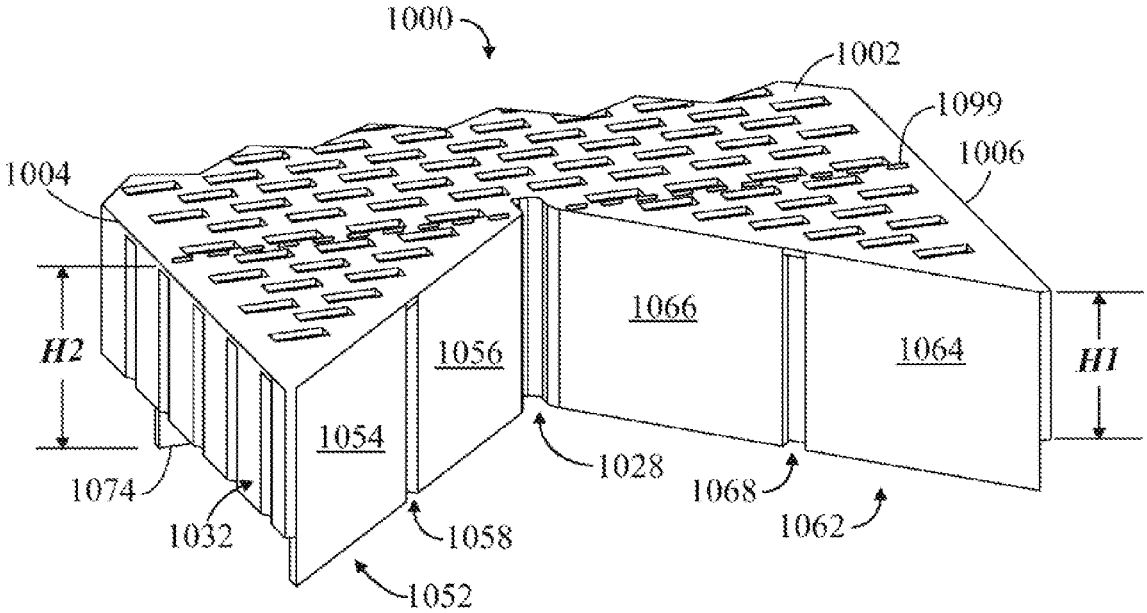

FIG. 10E is a perspective view of a portion of the flow controller for roof valleys, viewed from the top/front, according to the present invention.

Figure 11A:
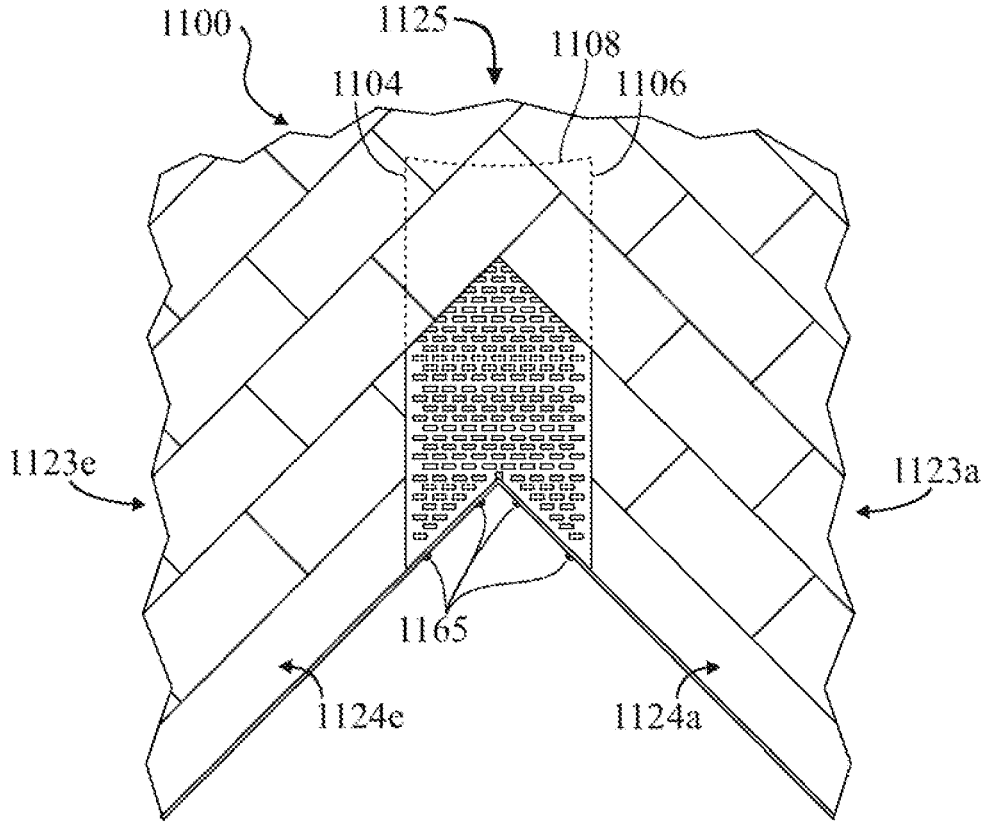

FIG. 11A is a front view of a portion of a house, showing two roof panels forming a valley, gutters at the edges of the two roof panels, and a flow controller installed in the valley, according to the present invention.

Figure 11B:
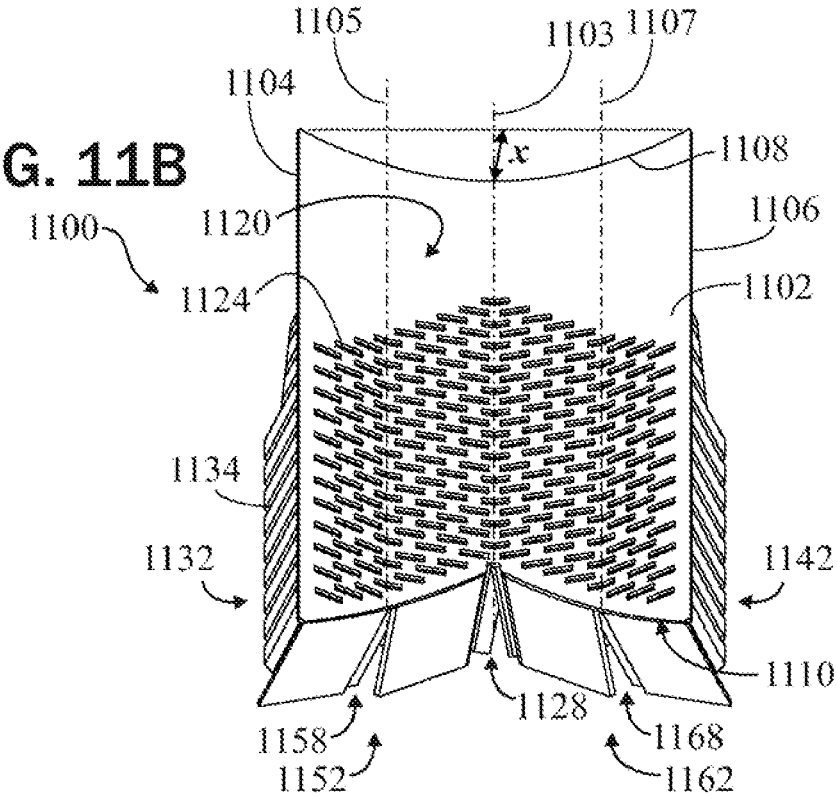

FIG. 11B is a perspective view of a portion of the flow controller shown in FIG. 11A, according to the present invention.

Figure 11C:
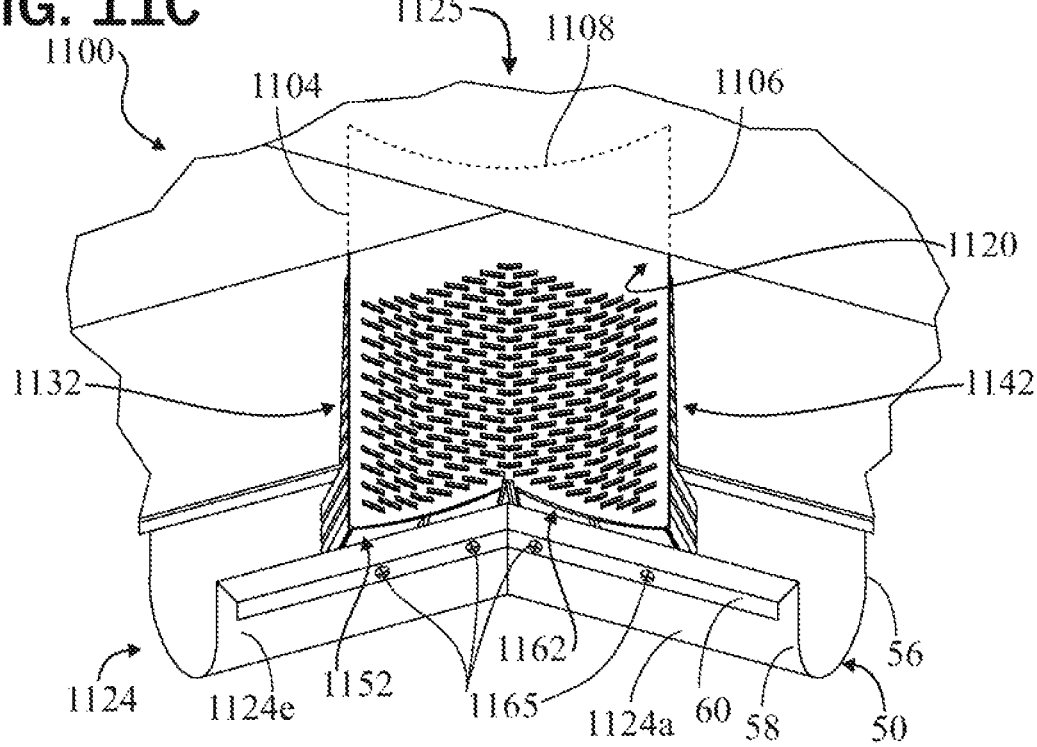

FIG. 11C is a perspective view of a portion of the roof panels, gutters and flow controller shown in FIG. 11A, according to the present invention.

Figure 11D:
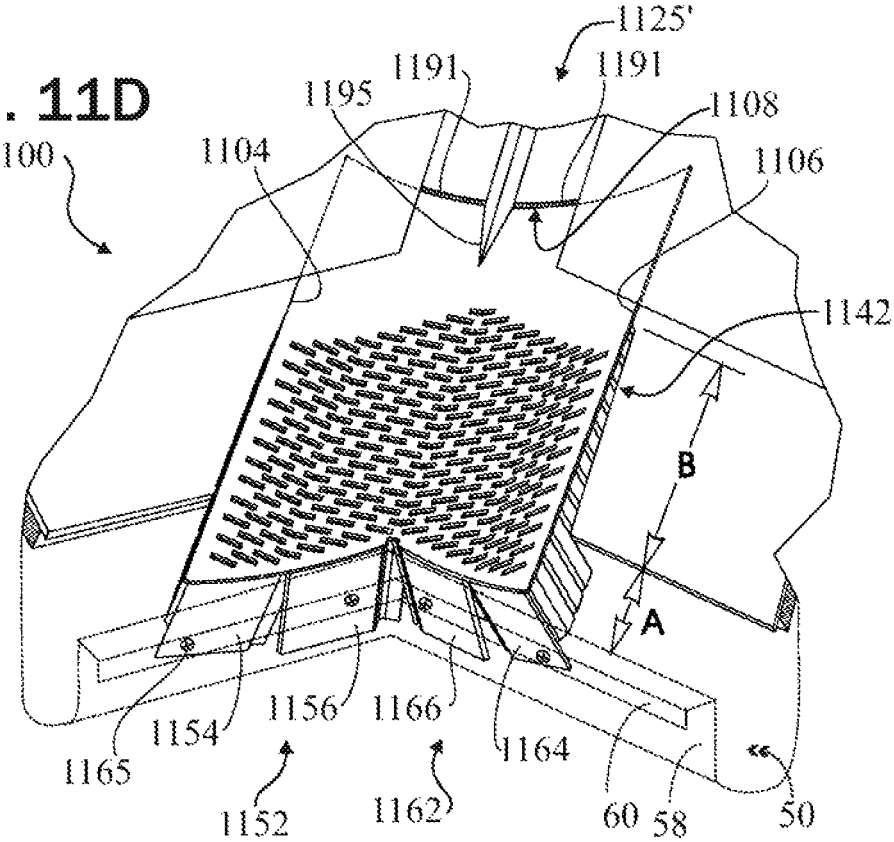

FIG. 11D is a perspective view of a portion of the roof panels, gutters and flow controller shown in FIG. 11A, according to the present invention.

Figure 12A:
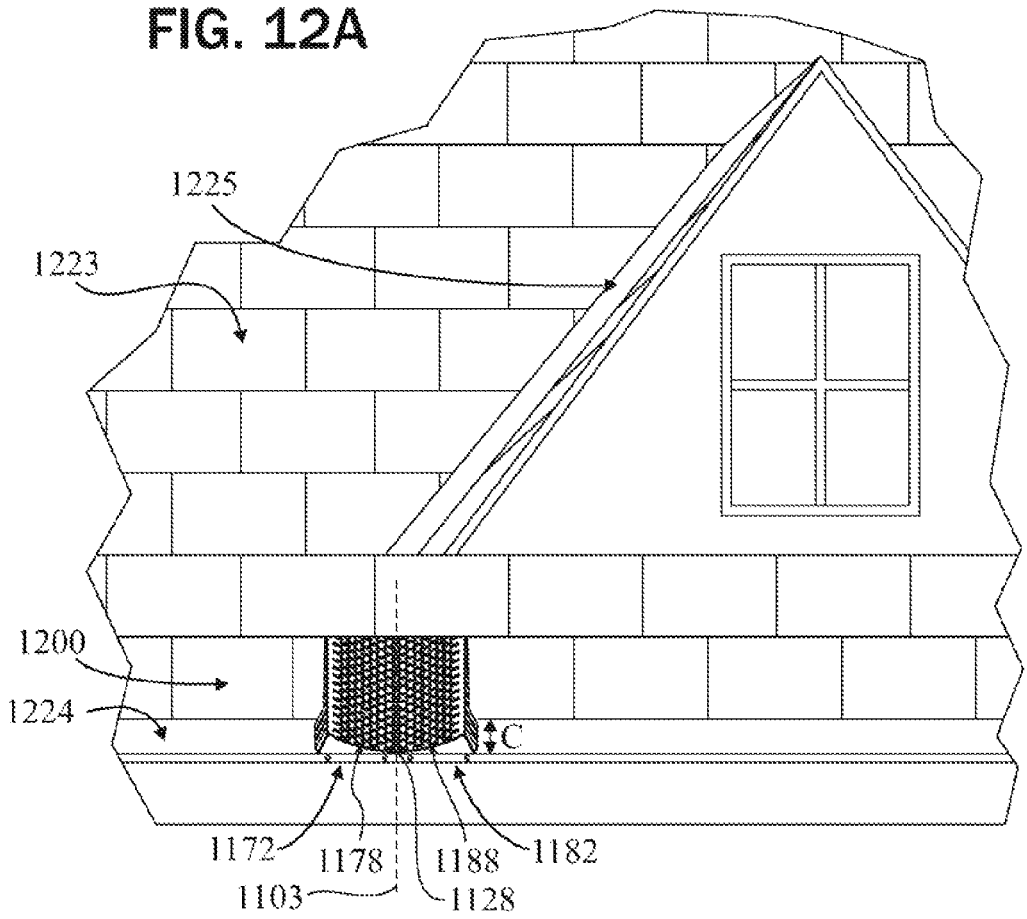

FIG. 12A is a front view of a portion of a roof having a dormer, and a flow controller installed below the dormer valley, according to the present invention.

Figure 12B:
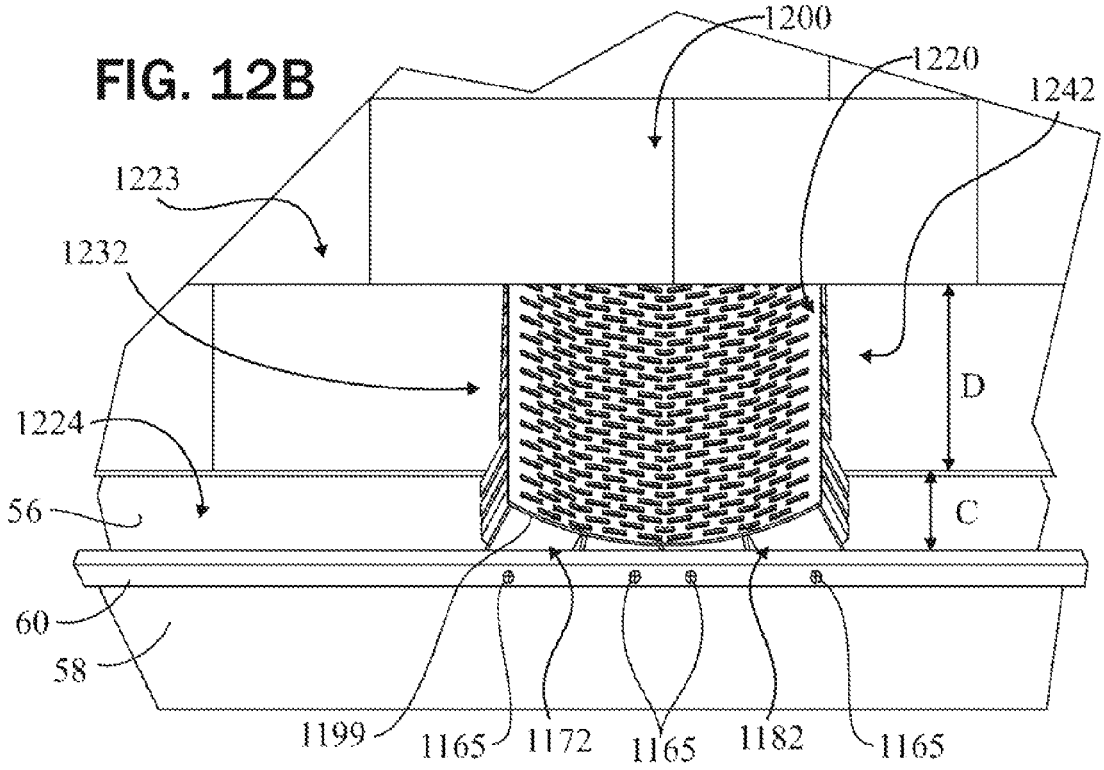

FIG. 12B is a magnified front view of a smaller portion of the roof of FIG. 12A, zoomed in to show details of the flow controller installed below the valley, according to the present invention.

DETAILED DESCRIPTION OF THE INVENTION

Gutter Shield

Referring to FIGS. 1-5, in accordance with the invention, there is provided a gutter shield 10 formed of a longitudinally extending length of planar stock material 12 (e.g., sheet aluminum, e.g., plastic material) having parallel inboard and outboard longitudinally extending lateral edges 14 and 16, respectively, separated by a distance W representing the width of the gutter shield 10 and, in most cases, also the width of the planar stock material 12. The gutter shield 10 further comprises a relatively wide inboard marginal area 18 and a relatively narrow outboard marginal area 20. An intermediate perforated portion 22 is disposed between the respective inboard and outboard marginal areas 18 and 20. The perforated portion 22 is formed with a plurality of intermittent open slots 24 arranged in parallel longitudinally extending rows. Each slot 24 is an aperture (hole, perforation through the shield 10) at the outboard edge of a tab 26 (also indicated in these figures as tab embodiments 26*d*, 26', 26") that is formed by down-ramping a portion of the stock material 12 immediately inboard from the slot 24. Thus the tab 26 forms a downward and outward sloping ramp as an inlet 30 for the slot 24, wherein the inlet 30 directs water into the slot 24 which has a sufficiently deep gap G (e.g., 0.06") to allow rain water therethrough, but is small enough to block seeds and small debris fragments from passing through or catching and clogging therein. The outboard edge 25 of the slot 24 (see detail in FIG. 4) is illustrated as a blunt squared off edge, but especially for thicker gauge stock material 12 it is advantageous to cut the edge 25 at a bias such that it functions as a sharp knife edge for cutting apart a large item of debris that might otherwise simply get stuck in the slot 24 and clog it.

FIGS. 1 and 2A illustrate the gutter shield 10 installed over a gutter 50 which is secured to the fascia board 52 of a pitched roof structure 54. It should be understood that the invention may be employed with a variety of roof structures. The pitched roof structure 54 illustrated is simply a convenient expedient for describing the invention and is a preferred application.

The gutter 50 is typically formed from a sheet of stock material having an upstanding inboard wall 56 which abuts the fascia 52 and an outboard upstanding wall 58 having a formed upper marginal edge 60 which turns inwardly of the gutter 50. A bottom wall portion 62 interconnects the respective inboard and outboard upstanding walls 56 and 58 to form an open trough portion 64. The gutter 50 may be secured to the fascia boards 52 by any conventional means including brackets (not shown) or long ferrule nails 65.

The conventional pitched roof structure 54 has a sheathing portion 66 which extends to the roof edge 70. The sheathing 66 is covered with overlapping rows of shingles 68. The roof edge 70 generally extends up to the fascia board 52, as illustrated. The gutter shield 10 is shown installed over the gutter 50. The inboard marginal area 18 is inserted between the sheathing 66 and the outermost/uppermost row of the shingles 68 and is optionally sealed and/or secured there by, for example roofing cement and/or nails. Generally there are at least two layers of shingles at the roof edge 70, with a "starter row" being laid on the sheathing 66 underneath the outermost row of the shingles 68. In addition, there may be a second or even a third layer of shingles 68 on the roof sheathing 66, newer layers having been added to cover older layers of worn-out shingles 68. At any rate, the inboard marginal area 18 of the gutter shield 10 can be inserted anywhere in the stack of shingles 68 as long as it at least lies underneath the uppermost layer of the outermost row of the shingles 68. The outboard marginal area 20 is secured to the upper marginal edge 60 of the gutter 50 by conventional means such as, for example, self-tapping screws 72.

In a preferred embodiment, the gutter shield 10 lies along and is generally aligned with the pitch of the roof structure 54, and the shingles 68 are disposed over the inboard marginal area 18. The perforated portion 22 is preferably located outboard of an outermost edge 84 of the shingles 68 and above the open trough 64 of the gutter 50 for directing rainwater and the like therein. In order to maintain a planar, downward and outward sloped perforated portion 22, the gutter shield 10 can be bent at a suitable angle as needed longitudinally along the inboard marginal area 18 and/or along the outboard marginal areas 20. FIG. 1 shows such a longitudinal bend 21 in the outboard marginal area 20.

FIGS. 1 and 2A illustrate two alternative modes of attaching (securing) the gutter shield 10 to the gutter 50. In FIG. 1, the entire outboard marginal area 20 lies on top of the gutter upper marginal edge 60, thus causing debris and any water that does not pass through the slots 24 to flow over or out beyond the outboard gutter wall 58. Referring to FIGS. 2A and 2B, most of the length of the outboard marginal area 20 lies below the gutter upper marginal edge 60 (e.g., trapped between the edge 60 and the ferrule nails 65), thus allowing water that does not pass through the slots 24 to flow between the marginal area 20 and the gutter marginal edge 60 and thereby into the gutter trough 64. The majority of debris should still be pushed out beyond the outboard gutter wall 58. Positioning and attachment of the gutter shield 10 is enabled by suitably spaced apart fastening flanges 48 that can be simply formed by cutting a pair of lateral slits in from the outboard lateral edge 16 and then bending the stock material 12 to offset it slightly upward between the paired slits. Each of these two attachment modes has its own advantages as described, and therefore they are alternative preferred embodiments, both of which are intended to be within the scope of the present invention.

It can be seen that the gutter shield 10 has a top (upper) surface 76 and an under side (lower or bottom surface) 78, and the tabs 26 ramp down away from the lower surface 78 as illustrated. Thus, any accumulated debris on the upper surface 76 tends to be washed toward the outboard edge 16 by rainwater and the like as it runs off the roof. Momentum and wind will then carry the debris off of the gutter shield 10. At the same time, it can be seen that the tabs 26 are formed such that the slots 24 are sufficiently wide so that rainwater running down along the top surface 76 of the shield 10 will pass through the slots 24 to enter the open trough 64 as directed by the tabs 26.

The inboard marginal area 18 of the shield 10 protects the roof sheathing 66 near the roof edge 70 and acts like a starting course for the shingles 68. It can be seen that the inboard marginal area 18 covers the roof sheathing 66 and protects it from water seepage. Also, the lie of the gutter shield 10 along the pitch of the roof helps to deflect water away from the roof sheathing 66 such that instead of dripping off the outermost edge 84 of the shingles 68, the water will instead travel downward/outward along the gutter shield 10 and through the slots 24 into the gutter 50.

In the embodiment illustrated in FIGS. 1-5, for a typical gutter system, the gutter shield 10 has an overall width W of about 6 inches and is made using a nominal 0.027 inch thick stock material 12. The inboard marginal area 18 is about 2 inches wide; the outboard marginal area 20 is about ½ inch wide; and the perforated portion 22 is about 3½ inches wide, all measured laterally. In the embodiment illustrated, the slots 24 have a first dimension W1 of about 7/16 inches and are spaced apart by spaces 23 having a second, smaller dimension W2 of about ⅜ inches. The slots 24 provide a gap G of about 0.026 inches for water to pass through, the gap G dimension being determined by the positioning of the tab 26 as it ramps downward.

The slots 24 extend longitudinally and are preferably aligned in regularly laterally spaced rows, with the slots 24 (and associated tabs 26) in each row being staggered relative to the slots/tabs 24/26 in adjacent rows such that a slot 24 is outward of, and overlapping, the space 23 between two slots/tabs 24/26 in the inward adjacent row. In this way, water that flows over the space 23 in one row will be directed into a slot/tab 24/26 immediately afterward in the next row.

Since the tab 26 is sloped downward and outward toward the associated slot 24, the tab 26 channels water flowing over the top surface 76, thereby directing the water toward and through the slot 24. The shape and relative dimensions of the slot 24 and tab 26 have important effects on the flowing water, especially in terms of encouraging capillary flow through the slot 24 while also breaking up sheeting of the water on the top surface 76 (which holds back flow down to the slot 24), and also breaking up sheeting of the water along the bottom surface 78 (which obstructs flow through the slot 24 and down into the gutter trough 64).

Referring particularly to FIGS. 4-8, important features of the inventive gutter shield 10 will be disclosed in several embodiments. FIGS. 4, 5A and 5B show side and front cross-sectional views of two alternate embodiments (26', 26") of a basic tab 26*d* according to the invention. FIGS. 6A, 6B, and 6C show side cross-sectional views of three enhanced embodiments (26*a*, 26*b*, 26*c*) of a tab 26 according to the invention. The reference number 26 is used herein to collectively refer to all embodiments (e.g., 26', 26", 26*a*, 26*b*, 26*c*, 26*d*) of the inventive tab 26.

In its simplest form, the basic tab 26*d* can be formed by: longitudinally slitting the stock material 12 (e.g., aluminum sheet metal) to form a slot 24 that is the dimension W1 in length and is bounded by an outboard slot edge 25 and an outboard tab edge 28*d*; by either cutting (cut tab 26') or stretch forming (formed tab 26") a pair of tab sides 29', 29" of length L1; and by bending the tab 26 downward at an uncut inboard tab edge 27 that is parallel to the outboard slot edge 25. When formed this way, the basic tab 26*d* will have a tab length L2 that is equal to the tab side lengths L1, and the slot 24 that forms the hole through which water can pass will have a slot gap dimension G that is determined by the perpendicular distance between the bottom of the outboard slot edge 25 and the nearest portion of the tab 26 (which for this basic tab 26*d* is the top of the outboard tab edge 28*d*). Since the size of the hole available for water passage is also affected by the tab sides 29', 29", the cut tab 26' is preferred over the formed tab 26"; and for a formed tab 26" the formed sides 29" are preferably as vertical as possible, thereby maximizing the width of the outboard tab edge 28 that is longitudinally straight and at the gap distance G (different embodiments of the outboard tab edge labeled 28*a*, 28*b*, 28*c*, 28*d* are generically and collectively referred to as outboard tab edge 28).

Thus the dimensions of the slot 24 in terms of gap G and width W1 determine a hole size, or aperture dimension that will have a first order effect on the maximum flow rate (throughput) of water through the inlet 30. For a given set of G and W1 dimensions, the effective aperture can be increased by using a cut tab 26' that has open tab sides 29'. The effective aperture can be further increased if the open tab sides 29' are bent (e.g., curled) downward away from the sides of the hole in the stock material 12 (thereby also imparting a downward curve to the outboard tab edge 28. Alternatively, the open tab sides 29' and/or the outboard tab edge 28 can be cut away to form a trapezoidal tab 26 (not illustrated) with a smaller surface area than the hole in the stock material 12.

Sheeting and capillary action are secondary effects on flow rate/throughput, but they can still have significant impact, and are important considerations in the present invention. In particular, effective aperture size of the slots 24 (inlets 30) can only be increased so far before the shield's separation or straining effectiveness is reduced to the point that undesirable amounts and sizes of debris are able to pass through into the gutter 50 or only partially through to become stuck and plugging the slot 24 as well as to cause accumulation of debris on the shield 10. Sheeting on the shield top surface 76 is broken up (perforated) by maximizing the size (L1 by W1) of the inlet hole 30 (thereby maximizing the weight of the water that is trying to fall through), and by minimizing the space 23 between holes, i.e., making dimension W2 as much smaller than W1 as possible while limited by a suitable bending strength for the perforated portion 22 of the shield 10. Perforation of the water sheet on top may also be helped by having the sharp edges that result from forming a cut tab 26'.

Capillary action is enhanced by forming the bend at the inboard tab edge 27 as a gradual, smoothly curving bend, i.e., a bend with a large radius of curvature. As shown in FIGS. 4, 6A and 6C, the tab 26 straightens out after the bend 27 to ramp downward and outward at a shallow angle relative to the shield surface 78, for example approximately 15 to 45 degrees, preferably about 30 degrees. As shown in FIG. 6B, the tab 26*b* has a curved cross-sectional shape (e.g., elliptical) that continues the gradual, smoothly curving bend shape all the way from the inboard tab edge 27 to the outboard tab edge 28*b*. The gradual, smoothly curving bend enables water surface tension and capillary action to hold the water against the down-ramping tab 26 in opposition to the lifting force of surface tension that is trying to hold the water sheet together above the inlet 30.

FIGS. 6A, 6B and 6C illustrate three exemplary alternate tab embodiments 26*a*, 26*b* and 26*c*, respectively, that are designed to prevent, break up, or at least to minimize water sheeting along the underside 78 of the shield 10. The illustrated alternate embodiments are examples of tabs 26 that are elongated such that the outboard tab edge 28 extends farther downward from the underside 78 than the basic tab 26*d*, while still maintaining the same gap G dimension (and therefore the same debris straining aperture characteristics). By extending further downward, the elongated tab 26*a*, 26*b*, 26*c* will push any water that is sheeting on the underside 78 further away from the underside 78, and therefore the elongated tab 26*a*, 26*b*, 26*c* will be more likely to break up such a sheet, detaching it from the underside 78 and causing it to fall down into the gutter trough 64 below. Importantly, such water sheet breaking will also prevent blockage of water flowing through the inlet 30 and off the end 28 of the tab 26. In fact, water that is not sheeting across the slot 24 but is flowing downward and outward along the underside of the tab 26 and off of the tab end 28 may actually enhance inlet 30 throughput by entraining water that is flowing downward and outward on the top of the tab 26 and off of the tab end 28. It should be apparent that elongated tabs 26*a*, 26*b*, 26*c* such as these, wherein the elongated tab 26*a*, 26*b*, 26*c* has a tab length L2 that is greater than the inlet hole length L1, will be most easily made as a part (e.g., plastic) that is either molded, or extruded and post-formed.

By way of example: a straight elongated tab 26*a* uses it's extra length L2 to place the tab end 28*a* farther away from the underside 78 of the shield, but has a substantially straight profile to maximize the entraining effect. Alternatively, a curved elongated tab 26*b* has an elliptical profile with the tightest curvature being after the tab 26*a* passes under the outboard slot edge 25 to establish the desired gap G dimension, thereby not only further lowering the tab end 28*b* but also curling the tab end 28*b* into a vertical (V) lip that still enables some degree of entraining because of the curved tab underside. Alternatively, a ridged elongated tab 26*c* has a breakwall ridge 32 extending downward at a sharp angle (e.g., 90°) at the tab end 28*c*. The breakwall ridge 32 is most effective in breaking apart a water sheet, but least effective in entraining.

FIGS. 7 and 8 illustrate another way to provide a breakwall underneath the gutter shield 10. Between adjacent rows of tabs 26 and slots 24, a longitudinally extending ridge-wall 36 extends downward at a sharp angle (e.g., 90 degrees) from the underside 78 of the shield 10. It is within the scope of this invention for a ridge-wall 36 to be non-linear and/or intermittent, although the continuous longitudinally linear form illustrated is the preferred embodiment. For example, the ridge-wall 36 could advantageously be zig-zagged and/or could incorporate lateral ribs, either of which would add to the lateral bending strength of the gutter shield 10. An advantage of the shield embodiment illustrated in FIGS. 7 and 8 is that in addition to being moldable or extrudable, it can also be continuously formed out of sheet metal using rolling ridge-formers to form folded ridges followed by rolling die/punches to form the tabs and slots.

Valley Shield

The gutter shield 10 described hereinabove is illustrated (e.g., FIGS. 1 and 2A) as being installed over a gutter 50 which is a straight section of gutter secured to the fascia board 52 of a pitched roof structure 54. We will now turn our attention to another roofing fixture for controlling water flow and filtering out (separating) debris that may be entrained in the water flow.

FIG. 9A is a top view of a house 900 having a simple rectangular floor plan. There are four outside walls 902*a*, 902*b*, 902*c* and 902*d* (collectively, walls 902). Adjacent walls 902, such as 902*a* and 902*b*, intersect each other at substantially 90-degrees, forming an "outside corner". The roof is a "hipped" roof design, wherein the roof slopes down on all four sides. (A "gable" roof slopes only to two opposite sides.) Four roof sections (panels) 903*a*, 903*b*, 903*c* and 903*d* (collectively, panels 903) are shown, extending to each of the corresponding four outside walls 902*a*, 902*b*, 902*c* and 902*d*.

Gutter sections 904*a*, 904*b*, 904*c* and 904*d* (collectively gutter sections 904) are shown mounted to the edges of the roof panels 903 at each of the corresponding walls 902*a*, 902*b*, 902*c* and 902*d*. One or more gutter sections 904 may also be referred to as "guttering" 904 (compare 50). Two adjacent gutter sections, such as 904*b* and 904*c* may be joined at a corner of the house 900. A downspout 906*a* is shown at the intersection of the gutter sections 904*b* and 904*c*. The other two adjacent gutter sections, such as 904*d* and 904*a* may be joined at the diagonally opposite corner of the house 900. A downspout 906*b* is shown at the intersection of the gutter sections 904*d* and 904*a*. Sections 908*a*, 908*b*, 908*c* and 908*d* of gutter shield (collectively gutter shield 908, compare 10), shown in dashed lines, may be installed over each of the corresponding gutter sections 904*a*, 904*b*, 904*c* and 904*d*.

FIG. 9B is a top view of a house 920 having an "L-shaped" floor plan, such as may be common when there is a garage partially extending outward from the front of the house 920. In this example, there are six outside walls 922*a*, 922*b*, 922*c*, 922*d*, 922*e* and 922*f*. Five roof sections (panels) 923*a*, 923*b*, 923*c*, 923*d* and 923*e* are shown, extending to each of the corresponding walls 922*a*, 922*b*, 922*c*, 922*d* and 922*e*. The roof sections 923*c*, 923*d* and 923*a* form a hipped roof design. The roof sections 923*b* and 923*e* form a gable roof design.

Gutter sections 924*a*, 924*b*, 924*c*, 924*d* and 924*e* are mounted to edges of the roof panels at each of the corresponding walls 922*a*, 922*b*, 922*c*, 922*d* and 922*e*. The roof is gabled (vertical, not sloped) over the wall 922*f*, so it does not need a gutter section. Gutter shields (e.g., 10) may be applied to the gutter sections 924, in the manner described hereinabove, but are omitted for illustrative clarity.

An important feature being illustrated in FIG. 9B is that two of the roof sections 923*a* and 923*e* intersect to form a "valley" 925, and that the adjacent walls 922*a* and 922*e*, and their associated gutter sections 924*a* and 924*e* intersect each other at a significant angle, typically about 90 degrees, thereby forming an inside corner. Roof valleys 925 are commonplace, especially in a form like that of the illustrated valley 925. The roof valley (e.g., valley 925) produces a localized increased flow of water as a stream concentrated from rain water running down the adjacent roof sections 923*a* and 923*e* as they get progressively narrower. This concentrated stream of water can gain enough momentum flowing down the valley 925 such that it will overshoot the outside edges of the intersecting gutter sections 924*a* and 924*e*. Therefore a flow controller is desired—one that does not clog with debris that is typically entrained in the water stream.

As shown in FIG. 12A, another type of valley 1225 may be formed (result from) the pitched roof of a dormer joining with the main pitched roof 1223 (compare 923) of a house. This dormer type of valley 1225 is distinguished in that it produces a localized increased flow of water that flows into a straight section of gutter 1224, not an inside corner. As for the roof valley 925, the concentrated stream of water from the dormer valley 1225 can gain enough momentum to overshoot the outside edge of the straight gutter 1224, so again a non-clogging flow controller is desired. Typically the dormer does not come down to the edge of the roof 1223 and gutter 1224, so typically the water stream from the dormer type of valley 1225 ends up flowing straight down the remaining portion of the roof 1223 to enter the straight gutter 1224 at a roughly right angle with respect to the longitudinal axis of the gutter 1224.

It will be seen that the flow controller (or "valley shield") of the present invention is firstly designed for use in a common roof valley (e.g., 925), but also has features that allow simple on-site modification to a configuration for use in conjunction with a dormer type of valley 1225, wherein the flow controller (e.g., flow controller 1200) is installed at a roughly right angle with respect to the longitudinal axis of the gutter (e.g., straight gutter 1224). It should be apparent that the roughly right angle installation of the flow controller 1200 is also advantageously applicable for any similar concentrated flow situation regardless of how the flow is produced. For example, a downspout from a gutter on a first roof may be directed to discharge down the slope of a second pitched roof 1223 (e.g., a porch roof).

FIGS. 10A-10E illustrate a preferred embodiment of the basic construction of a flow controller 1000 of the present invention. A general purpose of the flow controller 1000 is to control the flow of water from a roof 923, particularly the concentrated flow in a roof valley 925, into guttering 924 disposed at the edges of a roof 923, for example, at the inside corner described hereinabove formed by the adjacent walls 922*a* and 922*e*, and their associated gutter sections 924*a* and 924*e*, which intersect each other at substantially 90 degrees.

Another function of the flow controller 1000 may be to act as a water and debris separator for roof valleys 925. The flow controller 1000 may therefore be referred to herein as a "valley shield", and may be installed in conjunction with the gutter shield 10, described hereinabove. The valley shield 1000 may have certain features in common with the above-described gutter shield 10, but there are also many differences. Taken together, the valley shield 1000 and the gutter shield 10 may constitute a comprehensive "guttering system".

Because of the different orientation of a valley shield 1000, being longitudinal in a direction up and down the roof, rather than along the roof edge, certain terminology is changed hereinbelow from the forgoing gutter shield 10 description. In particular, for a gutter 50 and gutter shield 10, the "longitudinal" elongated direction is parallel to the roof edge, whereas the valley shield 1000 is longer in a "longitudinal" direction running up the roof. Similarly, the gutter shield 10 has an "inboard edge" closest to the roof, and an "outboard edge" farthest away, at the outside edge of the gutter 50. The valley shield 1000 generally extends along a valley 925 at a roof corner, where "outboard" has somewhat indefinite meaning. However, while the gutter shield 10 is generally horizontal, the valley shield 1000 is generally sloped along the roof pitch, so the term "inboard" is replaced by terms such as "upper" and "top end" or "back" (as viewed from the roof edge); while "outboard" is replaced by terms such as "lower" and "bottom end", or "front". Note that the terms "top end" and "bottom end" are distinguished from "top surface" and "bottom surface", because the meaning of top and bottom becomes unclear when a surface is slanted rather than horizontal.

In a preferred embodiment of the invention, the basic flow controller 1000 comprises a generally rectangular, generally planar piece of stock material 1002 (such as sheet aluminum, or semi-rigid plastic sheet material, preferably molded) having substantially parallel side edges 1004 and 1006 separated by a distance "S" representing the overall width of the flow controller 1000 (and, in some cases, also the width of the planar stock material 1002), and also having a top end (or back) edge 1008 and a bottom end (or front) edge 1010.

The side edges 1004 and 1006 are substantially equal in length, having a length dimension "L" representing the overall length of the flow controller 1000. For descriptive convenience, one of the side edges 1004 is designated the "left" side edge, the other (opposite) side edge 1006 is designated the "right" side edge (left and right being as seen in the top plan view of FIG. 10A).

A longitudinal axis 1003 is shown as a dashed line extending parallel to the two side edges 1004 and 1006, running down the middle of the planar stock material 1002, approximately midway between the two side edges 1004 and 1006, and dividing the flow controller widthwise. The valley shield 1000 is generally symmetrical about the longitudinal axis 1003. The left side edge 1004 has a top end 1004*a* and a bottom end 1004*b*. The right side edge 1006 has a top end 1006*a* and a bottom end 1006*b*.

The back edge 1008 of the flow controller 1000 is substantially perpendicular to the two side edges 1004 and 1006, and extends between the top ends 1004*a* and 1006*a* of the two side edges 1004 and 1006, respectively. The length of the back edge 1008 is, by definition, S, the overall width of the flow controller 1000.

The front edge 1010 of the flow controller 1000 is generally V-shaped, comprising a first (or left) front edge portion 1012 and a second (or right) front edge portion 1014. The left front edge portion 1012 extends from the bottom end 1004*b* of the left side edge 1004 to the longitudinal axis 1003. The right front edge portion 1014 extends from the bottom end 1006*b* of the right side edge 1006 to the longitudinal axis 1003. The left front edge portion 1012 meets the right front edge portion 1014 and forms an angle therewith, preferably an approximately 90 degree angle (hence the V-shape of the overall front edge 1012/1014). This angle is generally intended to match the substantially 90 degree angle inside corner formed by two adjacent roof edges (such as 922*a*, 922*e*) meeting below a valley (925), and the gutters (924*a*, 924*e*) associated therewith.

Some exemplary dimensions for the flow controller 1000 may be an overall width S of 8 inches, and overall length L of 19 inches. The dimensions of course are adaptable for different roofing styles. In general, the length L is preferably enough to extend the back edge 1008 up under the second row of shingles on the roof when the flow controller 1000 is installed properly.

The planar piece of material 1002 may be formed of sheet metal, such as aluminum, having a thickness of 0.0270 inches. Or, the planar piece of material 1002 may be formed of a plastic material, such as 0.080 inches thick. The flow controller 1000 can be made with a clear material to allow the underlying roof color to show through.

A lower portion 1016 of the flow controller 1000 is defined as a portion of the flow controller 1000 extending between the two side edges 1004 and 1006, from the front edge 1010 (1012/1014) partially along the length "L" of the flow controller 1000 towards the back edge 1008. An upper area 1018 of the flow controller 1000 is defined as a remaining portion of the flow controller 1000 extending between the two side edges 1004 and 1006, from the back edge 1008 partially along the length "L" of the flow controller 1000 towards the front edge 1010 (1012/1014). As an example, the lower area 1016 may constitute approximately 60% or more of the valley shield 1000, and the upper area 1018 may constitute approximately 40% or less of the valley shield 1000.

The planar stock material 1002 has a top surface 1020 which, when the flow controller 1000 is installed on a roof will be oriented towards the sky, and a bottom surface 1022 which, when the flow controller 1000 is installed will be oriented towards the roof.

The lower portion 1016 of the planar stock material 1002 is preferably perforated with a plurality of intermittent open slots 1024 arranged in parallel laterally (widthwise) extending rows. The slots 1024 may be generally identical to any of the slots 24 described hereinabove with respect to the gutter shield 10. For example, each slot 1024 may be an aperture (hole, perforation) through the planar stock material 1002 at the lower (front) edge of a tab 1026 (compare 26) that is formed by down-ramping (under the top surface 1020) a portion of the stock material 1002 immediately above/behind the slot 1024. Thus the tab 1026 forms a downward sloping ramp as an inlet (compare 30) for the slot 1024, wherein the inlet (30) directs water into the slot 1024 which has a sufficiently deep gap G (e.g., 0.080") to allow rain water therethrough, but is small enough to block seeds and small debris fragments from passing through or catching and clogging therein. Like the slot 1024 (24), the tab 1026 (26) may be generally identical to any of the tabs 26 (26', 26", 26*a*, 26*b*, 26*c*, 26*d*, and the like) as described hereinabove with respect to the gutter shield 10. Since the flow controller 1000 as a whole is pitched downward and frontward/outward like the roof 923 and valley 925 upon which it lies, the tab 1026 ramps downward at an even steeper angle than the gutter shield tab 26 in order to have a shape and angle relative to the top surface 1020 that is similar to the shape and angle of the tab 26 relative to the gutter shield top surface 76.

An advantageous design for the slots 1024 and tabs 1026 may be substantially identical to the design illustrated in FIG. 6C, wherein a ridged elongated tab 26*c* has a breakwall ridge 32 extending downward at a sharp angle (e.g., 90° relative to the plane of the tab 26*c*) at the tab end 28*c*. If applied to the tabs 1026, a breakwall ridge (like 32) should be comparably effective in breaking apart a water sheet that may form on the bottom surface 1022 (compare 78) of the planar stock material 1002. It should be apparent that "elongated" tabs (e.g., tabs 26*a*, 26*b*, 26*c*) having a tab length L2 that is greater than the inlet hole length L1, will be most easily made as a part (e.g., plastic) that is, for example, molded, rather than punched or extruded.

Two side walls 1032, 1042, two front walls 1052, 1062, and two inner walls 1072, 1082 of the flow controller 1000 extend downward, substantially at right angles from the bottom surface 1022 of the planar stock material 1002, and will now be described. The term "substantially at a right angle" is employed to indicate that the angle is significant (e.g., more than 45 degrees) and also is an abrupt change of direction rather than a gradual bend. The illustrations in the drawings generally show a 90 degree angle, and this will work, but as will be seen in the foregoing teaching the front walls may be easier to attach to an upstanding wall of a gutter if the "substantially right angle" between the bottom surface of the planer stock material and the front wall were actually flared out to more like 100 or so degrees so that the front wall will be more parallel to the gutter wall when the flow controller 1000 is installed according to the invention. Of course the 90 degree angle still works because the stock material 1002 used for constructing the flow controller 1000 is sufficiently flexible to bend as needed to enable such attachment. Regardless of the actual number of degrees it spans, the "substantially right angle" will still preferably constitute an abrupt change to produce a relatively "sharp" edge such that debris will be ejected straight off the front of the controller 1000 over the front edge 1010, and also such that the side edges 1004, 1006 will be raised as high as possible when the stock material 1002 is pressed into a laterally concave curve.

The two front walls 1052 and 1062 constitute two portions of a single front wall 1052/1062 of the flow controller 1000. The two inner walls 1072 and 1082 constitute two portions of a single inner wall 1072/1082 of the flow controller 1000.

A first (left) sidewall 1032 extends downward from the left side edge 1004 of the flow controller 1000, from the bottom end 1004*b* of the left side edge 1004, towards the top end 1004*a* of the left side edge 1004, terminating at a point SW1 along the left side edge 1004. The left sidewall 1032 may be generally rectangular. As illustrated, however, the left sidewall 1032 tapers (decreases in height, not necessarily linearly) from a height "H1" at the bottom end 1004*b* of the left side edge 1004 to a lesser dimension at the point SW1.

The left sidewall 1032 is segmented into several (such as ten to twelve) distinct, generally rectangular portions (vertical "tabs") 1033 by a plurality of slits 1034. The slits 1034 are for allowing water to pass through the left sidewall 1032 from outside of the flow controller 1000 to underneath the planar stock material 1002, while screening out debris. In this regard, the slits 1034 function like the slots 1024, optionally including ramped portions similar to the tabs 1026.

A second (right) sidewall 1042 extends downward from the right side edge 1006 of the flow controller 1000, from the bottom end 1006*b* of the right side edge 1006, towards the top end 1006*a* of the right side edge 1006, terminating at a point SW2 along the right side edge 1006. The right sidewall 1042 may be rectangular. As illustrated, however, the right sidewall 1042 tapers (decreases in height, not necessarily linearly) from a height "H1" at the bottom end 1006*b* of the right side edge 1006 to a lesser dimension at the point SW2.

Similar to the left sidewall 1032, the right sidewall 1042 is segmented into several (such as ten to twelve) distinct, generally rectangular portions (vertical tabs) 1043 by a plurality of slits 1034. The slits 1034 are for allowing water to pass through the right sidewall 1042 from outside of the flow controller 1000 to underneath the planar stock material 1002, while screening out debris.

The sidewalls 1032 and 1042 have an overall length of "L11". A remaining distance "L12" is the overall length of the portion of side edges 1004 and 1006 that does not have sidewalls 1032 and 1042.

A portion of each sidewall 1032 and 1042 extends from the front edge 1012 and 1014 of the flow controller 1000 for a distance labeled "A" towards the back edge 1008 of the flow controller 1000. As shown in FIG. 11D, this "A" portion of the sidewalls 1032 and 1042 will fit into the trough of a gutter 50 that forms an inside corner below the valley (e.g., gutter 924*a*, 924*e* below valley 925).

Another portion of each sidewall 1032 and 1042 is designated the "B" portion of the sidewalls, and extends from the "A" portion to the end points SW1 and SW2 of the sidewalls 1032 and 1042, respectively. As shown in FIG. 11D, this "B" portion of the sidewalls 1032 and 1042 will support the side edges 1004 (1104) and 1006 (1106) above the surface of the roof, and the "B" sidewall portions 1032 and 1042 may be trimmed to conform to the plane of the roof panels, but tapering to a zero height toward the back edge 1008 (1108) so that the top portion of the valley shield 1000 (1100) may be installed under a row of shingles without permanently lifting them.

Another portion of each sidewall 1032 and 1042 extends from the inner walls 1072 and 1082, respectively, for a distance labeled "C" towards the back edge 1008 of the flow controller 1000. As shown in FIG. 12B, this "C" portion will fit into the trough of a straight section of gutter 1224 as described hereinbelow.

Another portion of each sidewall 1032 and 1042 is designated the "D" portion, and extends from the "C" portion to the end points SW1 and SW2 of the sidewalls 1032 and 1042, respectively. As shown in FIG. 12B, this "D" portion will support the side edges 1004 and 1006 of the planar stock material 1002 above the surface of the roof, and the "D" sidewall portions 1032 and 1042 may be trimmed to conform to the plane of the roof panels, but tapering to a zero height toward the back edge 1008 so that the top portion of the valley shield/flow controller 1200 may be installed under a row of shingles without permanently lifting them.

Preferably the sidewalls 1032 and 1042 are formed such that the transition in sidewall height "H1" from the high to the lower height that marks the beginning of the portion that tapers down to a lesser height at SW1 and SW2 is an abrupt change in height as shown, and preferably this transition is at the point where the C portion joins the D portion. All of the dimensions are designed to accommodate typical shingle and gutter dimensions, but with the knowledge that the dimensions can be reduced but not increased by an installer of the valley shield 1000. For example, the "C" portion of the sidewalls 1032 and 1042 may have a length "C" of about 5 inches and a height "H1" of 2.5"; and the "D" portion of the sidewalls 1032 and 1042 may have a length "D" of 3 inches and a height of 0.25". It should be apparent that, since the sidewalls 1032 and 1042 are made to be trimmable, a highly adaptable but somewhat less convenient, universal form for the flow controller 1000 is a simple one in which the sidewalls 1032 and 1042 are a single height Hi for the entire length L of the side edges 1004 and 1006 (i.e., L11=L and L12=zero).

A first (or left) outer front wall portion 1052 extends downward from the left front edge portion 1012 of the flow controller 1000. The left outer front wall portion 1052 may be generally rectangular. The left outer front wall portion 1052 extends from approximately the left side wall 1004 to the longitudinal axis 1003. The left outer front wall portion 1052 has an overall length corresponding to the length "S1" of the left front edge portion 1012, and has a height "H2", such as 2.5", which may be slightly greater than the height "H1" of the left side wall 1004.

The left outer front wall portion 1052 may comprise two overlapping, generally rectangular, generally coplanar portions (or panels) 1054 and 1056, each having a length of approximately half of the overall length "S1" of the left outer front wall portion 1052, and heights of substantially "H2". At the overlap between the two portions 1054 and 1056, a joint 1058 is formed, also referred to generically as a "pleat". The joint/pleat 1058 may be similar to a conventional "lap joint", except that the two portions 1054 and 1056 may not actually be joined with one another, but rather may be just substantially touching each other so that the two portions 1054 and 1056 are free to move slightly, with respect to one another, while staying in contact with one another, as described in greater detail hereinbelow.

A second (or right) outer front wall portion 1062 extends downward from the right front edge portion 1014 of the flow controller 1000. The right outer front wall portion 1062 may be generally rectangular. The right outer front wall portion 1062 extends from approximately the right side wall 1006 to the longitudinal axis 1003. The right outer front wall portion 1062 has an overall length corresponding to the length "S2" of the right front edge portion 1014, and has a height "H2" (substantially equal to the height of the left outer front wall 1052). The front wall portions 1052/1062 are preferably dimensioned to a greater height H2 than is normally required so that the installer can trim it to accommodate variations in building construction and vertical separation of the guttering below the roof edge.

The right outer front wall portion 1062 may comprise two overlapping, generally rectangular, generally coplanar portions (or panels) 1064 and 1066, each having a length of approximately half of the overall length "S2" of the right outer front wall portion 1062, and heights of substantially "H2". At the overlap between the two portions 1064 and 1066, a joint/pleat 1068 is formed. The joint 1068 may be similar to a conventional "lap joint", except that the two portions 1064 and 1066 may not actually be joined with one another, but rather may be just substantially touching each other so that the two portions 1064 and 1066 are free to move slightly, with respect to one another, while staying in contact with one another, as described in greater detail hereinbelow.

As best viewed in FIG. 10D, central ends of the outer front wall portions 1052 and 1062 meet at the longitudinal axis 1003, and overlap one another, forming a joint/pleat 1028 which may be similar to a conventional "lap joint", except that the two outer front walls 1052 and 1062 may not actually be joined with one another, but rather may be just substantially touching each other so that the two front walls 1052 and 1062 are free to move slightly, with respect to one another, while staying in contact with one another, as described in greater detail hereinbelow.

The joints 1058, 1068 and 1028 are also referred to as "pleats", since they may function in a manner similar to conventional pleats in that they allow two parallel panels to spread slightly apart while remaining connected with one another in some fashion. In this illustrated case, the two parallel panels of the "pleat" 1058, 1068, 1028 are overlapping such that they are, in effect, slidingly "joined", similar to fabric pleats with overlapping z-folds. Additional joints 1078 and 1088 are described hereinbelow, and function similarly to the joints 1058, 1068 and 1028, in that they allow two panels overlapping at ends thereof to move slightly with respect to one another, while maintaining a juxtaposition (substantially touching one another) so that the two panels which are joined (e.g., overlapping) can form a substantially water-tight barrier. In another resemblance to pleats in a skirt, the panels of the pleats/joints 1058, 1068, 1028, 1078 and 1088 are joined by the top surface 1020 (compare to waist of skirt), such that they can be spread apart pivotally like the overlapping flat ribs of a fan.

The outer front walls 1052 and 1062 are "outer walls" in that they follow a respective frontmost edge 1010 (1012 and 1014) of the planar stock material 1002 and thus form part of an external surface of the flow controller 1000. Two "inner" walls 1072 and 1082 are also provided which are internal to the flow controller (not along an edge of the planar stock material 1002), and will now be described. The triangular portions of the flow controller 1000 (i.e., portions of the planar stock material 1002) between the front walls 1052, 1062 and the inner walls 1072, 1082 are designated "wings" 1059 and 1069 as shown in FIG. 10D.

A first (or left) inner wall 1072 extends from the "pleat" 1028 (at the longitudinal axis 1003) to a point "SW3" along the left side edge 1004 of the planar stock material 1002 (the view in FIG. 10D is of the bottom, therefore right and left sides are reversed). The left inner wall 1072 may be generally rectangular. The left inner wall 1072 may have an overall length corresponding to half the width "S" of the planar stock material 1002, and has a height "H2" which is substantially equal to the height of the left outer front wall 1052. The left inner wall 1072 extends substantially from the left side edge 1004 to the longitudinal axis 1003.

The left inner wall 1072 may comprise two overlapping, generally rectangular, generally coplanar portions (or panels) 1074 and 1076, each having a length of approximately one quarter of the width "S" of the planar stock material 1002, and a height of substantially "H2". At the overlap between the two portions 1074 and 1076, a joint/pleat 1078 is formed. The joint 1078 may be similar to a conventional "lap joint", except that the two portions 1074 and 1076 may not actually be joined with one another, but rather may be just substantially touching each other so that the two portions 1074 and 1076 are free to move slightly, with respect to one another, while staying in contact with one another.

A second (or right) inner wall 1082 extends from the "pleat" 1028 (at the longitudinal axis 1003) to a point "SW4" along the right side edge 1006 of the planar stock material 1002. The right inner wall 1082 may be generally rectangular. The right inner wall 1082 may have an overall length corresponding to half the width "S" of the planar stock material 1002, and has a height "H2" which is substantially equal to the height of the right outer front wall 1062. The right inner wall 1082 extends substantially from the right side edge 1006 to the longitudinal axis 1003.

The right inner wall 1082 may comprise two overlapping, generally rectangular, generally coplanar portions (or panels) 1084 and 1086, each having a length of approximately one quarter of the width "S" of the planar stock material 1002, and a height of substantially "H2". At the overlap between the two portions 1084 and 1086, a joint/pleat 1088 is formed. The joint 1088 may be similar to a conventional "lap joint", except that the two portions 1084 and 1086 may not actually be joined with one another, but rather may be just substantially touching each other so that the two portions 1084 and 1086 are free to move slightly, with respect to one another, while staying in contact with one another.

The inner walls 1072 and 1082 may be substantially coplanar with one another extending, at substantially right angles to the side edges 1004 and 1006, transversely across the width of the planar stock material 1002, and at a substantially right angle (90 degrees) to the longitudinal axis 1003.

As best viewed in FIG. 10D, the pleat 1028 formed at the overlap of the two front wall portions 1052 and 1062 is disposed substantially at the longitudinal axis 1003 which divides the flow controller into substantially two, "mirror image", left and right portions.

The pleat 1058 in the left outer front wall portion 1052 is disposed on a line 1005 which extends parallel to the longitudinal axis 1003. The line 1005 is located approximately halfway between the longitudinal axis 1003 and left side edge 1004. The pleat 1078 in the left inner wall 1072 is also disposed substantially on this line 1005.

The pleat 1068 in the right outer front wall portion 1062 is disposed on a line 1007 which extends parallel to the longitudinal axis 1003. The line 1007 is located approximately halfway between the longitudinal axis 1003 and the right side edge 1006. The pleat 1088 in the right inner wall 1082 is also disposed substantially on this line 1007.

The axis 1003 and lines (or axes) 1005 and 1007 constitute "bend axes" which, along with the corresponding pleats 1028, 1058, 1068, 1078, 1088 permit the otherwise planar stock material 1002 to be deformed (bent), as described in greater detail hereinbelow. Importantly, the pleats 1028, 1058, 1068, 1078, 1088 also form a substantially complete water flow barrier or "breakwall" for normally impinging water flows, even when the flow controller 1000 is deformed, as will be seen hereinbelow.

Installation

An installation of a flow controller/valley shield 1100 on a roof 1123 of a house is now discussed, and reference is made to FIGS. 11A-11D and also to 12A-12B. A purpose of the flow controller 1100, as of the flow controller 1000 discussed hereinabove, is to control the flow of water from a roof surface (which may be two adjoining roof surfaces) into guttering, which may be one or more gutters disposed at bottom edge(s) of the roof surface(s).

The valley shield (or flow controller or controller) 1100 is, in most of its physical elements, essentially the same as the abovedescribed valley shield 1000, but is given a different reference number due to its being illustrated as it will appear when installed on a roof. As it will be seen, a preferred embodiment of the valley shield 1000 is the installed valley shield 1100 which is deformed and trimmed in a prescribed way during installation so that it performs its functions optimally. Thus the uninstalled controller 1000 can be thought of as an element of a "kit" wherein the controller 1000 is provided with installation instructions so that the inventive shape and positioning relative to a roof and gutter of the installed controller 1100 can be obtained—in effect completing the construction of the inventive controller 1000 or 1100. Thus the installation instructions (method) become an element of a preferred embodiment 1100 of the invention. Of course the uninstalled controller 1000 is also an embodiment of the present invention, in that it is designed such that it can be installed according to the inventive installation method. Furthermore, even if not installed with the prescribed bend and/or trimming, the basic controller 1000 will still provide many of the benefits of the inventive design and construction.

Generally, for a common roof valley 1125 (compare 925), two exemplary roof panels 1123*a* and 1123*e* (compare 923*a* and 923*e*) meet at an angle and form a valley 1125. Gutters 1124*a* and 1124*e* (compare 50, 924*a* and 924*e*) are installed at the outer edges of the two roof panels 1123*a* and 1123*e*, and a flow controller 1100 substantially alike the flow controller 1000 described hereinabove is installed in the valley 1125 (and in the gutters 1124*a* and 1124*e*).

Each portion of guttering 1124*a* and 1124*e* (compare 50) has an inboard upstanding wall 56 and an outboard upstanding wall 58, and the outboard upstanding wall 58 may be provided with a formed upper marginal edge, or lip 60 which extends either inward (as illustrated in FIGS. 1 and 2A) or outward (as illustrated in FIG. 11C). Thus the gutters 1124*a* and 1124*e* are conventional gutters (compare 924*a* and 924*e*), attached in any suitable manner to the house at the edges of the sloping roof panels (compare 923*a* and 923*e*, respectively).

Referring particularly to FIG. 11B, the flow controller 1100 comprises a generally planar piece of stock material 1102 (compare 1002) having left and right side edges 1104 and 1106 (compare 1004 and 1006), a back edge 1108 (compare 1008), and a V-shaped front edge 1110 (compare 1010). Three pleats 1128, 1158 and 1168 (compare 1028, 1058 and 1068) are disposed in left and right front walls 1152 and 1162 (compare 1052 and 1062) on the front edge 1110, as described hereinabove for pleats 1028, 1058 and 1068. A longitudinal axis 1103 (compare 1003), a line 1105 (compare 1005) between the longitudinal axis 1103 and the left side edge 1104, and a line 1107 (compare 1007) between the longitudinal axis 1103 and the right side edge 1106 are shown, all three lines being "bend axes" as described hereinabove. A left side wall 1132 (compare 1032) and a right side wall 1142 (compare 1042) are shown. Vertical slits 1134 (compare 1034) form debris-filtering water passages through the side walls 1132, 1142; and lateral slots 1124 (compare 1024) form debris-filtering water passages through a top surface 1120 (compare 1020) of the stock material 1102 of the flow controller 1100.

When the flow controller 1100 is installed in a roof valley 1125, it is intentionally deformed into somewhat of a laterally concave or arcuate shape, being lower in the center along the longitudinal axis 1103, than at its side edges 1104 and 1106. This causes the pleats 1128, 1158, 1168 to spread open like fans, being slightly wider at the bottom (as viewed) than at the top (as viewed). Although not seen in the view of FIGS. 11A-11D, the inner walls (e.g., 1072, 1082 shown in FIG. 10D) can be left in place for this installation, and therefore their pleats (e.g., 1128, 1078, 1088) will spread open in the same fashion. As best seen in FIGS. 11C-11D, the flow controller 1100 is then fixed in the deformed shape and secured in place using, for example, self taping screws 1165 (compare screws 72) extending through the outer upstanding wall 58 and/or lip 60 of the gutters 1124*a* and 1124*e* into the front walls 1162 and 1152, respectively. Installation may be best accomplished by first securing the rightmost and leftmost panels (1154 and 1164, respectively) of the front wall 1152/1162 to the inside front 58/60 of the gutter 50. Then the installer may push downward on the controller 1100 where he wants the lowest point to be. He may then install additional screws 1165 into the innermost panels (1156 and 1166, respectively) of the front wall 1152/1162, thus holding the top surface 1120 in the arced configuration he has chosen (noting that the low point in a roof valley 1125, 1125' typically varies somewhat as to where it joins the gutter 50).

It is within the scope of the invention to utilize any suitable modification of a vertical barrier wall (e.g., 1152 plus 1162) for allowing this deformation, exemplified by the fanning, overlapping-panels type of "pleat/joint" 1028, 1058, 1068, 1078 and 1088 described hereinabove. For example, slits, accordion folds, stretchable material or the like, may be incorporated into the front walls 1152 and 1162 and inner walls (e.g., 1072, 1082). Furthermore, it should be understood that the "arcuate" curve shape is only approximately arcuate, since it is actually segmented rather than smoothly arcing due to the three bending lines 1103, 1105, and 1107 allowed by the three pleats 1128, 1158 (and 1078), and 1168 (and 1088), respectively. More pleats, such as a continuous accordion fold, would provide a smoother curve but the exemplary three-segment curve shape is adequate, and even a single central pleat 1128 may suffice.

Regarding the deformation of the flow controller 1100, for example, in FIGS. 11B and 11C it can be seen that the planar stock material 1102 becomes non-planar or "curved", i.e., the side edges 1104 and 1106 are higher, by a distance "x", than the middle of the planar stock material 1102 at the longitudinal axis 1103. For example, the dimension "x" may be about ¼ but can be more depending upon the valley dimensions under the flow controller 1100.

As best viewed in FIG. 11C, when the flow controller 1100 is installed in a roof valley 1125, the front walls 1152 and 1162 are positioned within the gutters 1124*e* and 1124*a*, respectively (collectively referenced as guttering 1124, or simply gutter 50).

The front wall 1152/1162 (constituted by the two front wall portions 1152 and 1162) provides a breakwall for substantially preventing rainwater flowing down the roof surfaces under the flow controller 1100 (i.e., in the valley 1125) from flowing over the top of the outer wall 58 of the gutter 50.

For a "laced shingle" valley 1125 as illustrated in FIGS. 11A and 11C, the back end 1108 of the flow controller/valley shield 1100 is pushed up under at least one of the overlapping shingles of (preferably) the second row of shingles.

For a flashing type of valley 1125' as illustrated in FIG. 11D, the back end 1108 might be only partially, if at all, pushed up under (preferably) the second row of shingles. In this case, the installer uses an adhesive 1191 (e.g., tar, caulk, sealant, etc.) to secure the upper edge 1108 to the flashing of the valley 1125' (preferably forming a smooth transition from the flashing of the valley 1125' to the top surface 1120 of the flow controller 1100). If needed, the installer can make a cutout 1195 to smoothly accommodate the shape of a formed valley 1125' such as the one shown, for example. These accommodations are optional and can be applied as needed to hold the back edge 1108 down against the valley 1125' so that there isn't any significantly raised edge that can catch debris and form a water dam.

Regardless of valley type—shingled 1125 or flashed 1125'—the installer should cut (trim) the "B" portion of the sidewalls 1132, 1142 such that they taper in height so that the back edge 1108 of the valley shield 1100 will fit under the shingles and/or lie flat against the roof. The "A" portion of the sidewalls 1132, 1142 is left uncut at its as-supplied height H1 such that it will extend down into the guttering 50, 1124, thereby further controlling water flow by preventing excessive lateral splashing. If used in conjunction with a gutter shield 10, then the "A" portion can be trimmed as needed to rest on top of the gutter shield 10, or else the gutter shield 10 can be cut to end at the sidewall 1132, 1142. Another benefit of tapering the "B" portion of the sidewalls 1132, 1142 is that this causes the valley shield 1100 to be progressively higher above the valley 1125 (or 1125') as it extends downward/forward. This provides an increasing volume for the space under/within the valley shield 1100 thereby accommodating the progressively increasing volume of water that is concentrating in the valley 1125 as it essentially "angles across" more and more of the rained-upon roof surfaces of two intersecting roof panels 1123*e* and 1123*a*.

Alternative Use for Flow Controller

As mentioned above, roof valleys are commonplace, and may also be formed (result from) the pitched roof of a dormer joining with the pitched roof of the main house. As illustrated in FIG. 12A, a different configuration of a valley 1225 is formed when a dormer extends from a roof panel 1223, as contrasted with the common valley (e.g., 925, 1125, 1125') formed by two intersecting roof panels, as described hereinabove.

FIGS. 12A and 12B illustrate a portion of a roof 1223 having a dormer that creates a valley 1225. A flow controller 1200 is installed below the valley 1225 for controlling the excess water flow from the valley 1225. The flow controller 1200 as shown is a trimmed version of the flow controller 1000, wherein the wings 1059, 1069 between the outer front walls 1052/1152, 1062/1162 and the inner walls 1072/1172, 1082/1182 have been trimmed away to leave a perpendicular breakwall, formed by the inner walls 1172, 1182, which now form the front (lower) end of the flow controller 1200, parallel to the outer wall 58 of the gutter 1224, where it can be screwed 1165 in place as described hereinabove, including having a curved top surface 1120 created by the installer pressing down on the centerline 1103.

Generally, for installing the flow controller 1000 (or 1100) in a common roof valley, such as valleys 1125, 1125' illustrated in FIGS. 11A-11D, the inside walls 1172 (compare 1072) and 1182 (compare 1082) may be trimmed away or simply left in place since they will extend down into the gutter 50. A knife or snips can be used for trimming any parts of the valley shield/flow controllers 1000, 1100, 1200, depending upon the material used in the shield, or a perforated line 1099 can be provided so that they can be folded back and forth, and snapped off at the perforated line 1099. For example, a line 1099 of perforations through the stock material 1002 is shown in FIG. 10D where it crosses the controller 1000 forward of the inner walls 1072, 1082—thereby providing an installer with a simple way to snap off the wings 1059 and 1069. As shown in FIG. 12B, then, the perforated break-off line 1099 becomes the new front edge of the controller 1200 when it has been trimmed by an installer for installation under a dormer valley 1225 or the like. It may be noted that the center pleat 1028 of the controller 1000 is illustrated as if it is formed by overlapping ends of the two outer front wall portions 1056 and 1066. Obviously this would make breaking off the wings 1059, 1069 difficult, and/or could create a gap in the remaining inner wall 1072/1082. It should be apparent that this problem is easily resolved within the scope of the invention by simply using the inner wall panels 1076 and 1086 to form the pleat 1028 instead.

As noted hereinabove in the description of the construction of the flow controller 1000, when the dormer valley controller 1200 is installed, portions of the sidewalls 1232 (compare 1032) and 1242 (compare 1042) should be trimmed according to the prescribed installation method of the present invention. With reference to FIG. 12B, the "C" portion of the sidewalls 1232, 1242 should fit into the trough of a straight section of gutter 1224 and may need to be trimmed to fit between the outer wall 58 of the gutter and the outer edge of the roof 1223. The "C" portion may also be trimmed to interface as desired with a gutter shield 10 (not shown). The "D" portion of the sidewalls 1232, 1242 should be trimmed to taper to a zero height as it extends up the roof 1223, so that the valley shield/flow controller 1200 may be installed under a row of shingles without permanently lifting them, and also so that the shield 1200 as-installed will have a progressively increasing height above the roof 1223 as it extends out/down to the gutter 1224.

Kit and Fixed Embodiments

It has been mentioned that the basic flow controller 1000 as described so far can be considered an element of a "kit" that further includes installation instructions (an inventive method) that, when followed by an installer yield an enhanced embodiment of the invention, an installed flow controller 1100 or 1200. These enhanced embodiments 1100 or 1200 have a curved top surface 1120 or 1220 and trimmed sidewalls 1132, 1142 or 1232, 1242. The dormer valley shield 1200 also has trimmed-off wings 1059, 1069.

It is also within the scope of the present invention to "build-in" the enhancements such that the uninstalled flow controller 1000 has the enhancements fixed in place such that the controller 1000 as-sold, has the desired shape of the installed controller 1100 or 1200 without requiring a specified installation method. Thus the "fixed" version of the standard valley shield/controller 1100 will be curved as shown in FIGS. 11B-11D and the curvature will be fixed by making the front wall 1152/1162 as a single piece of material—effectively solidifying the pleats 1128, 1158, 1168 in the expanded form shown. Of course this would be simplified by eliminating the pleating to create two straight walls 1152 and 1162. Such a design variation would also allow a continuous curve to be molded rather than a segmented one. The fixed controller 1100 will also have the sidewalls 1032, 1042 pre-formed with a tall "A" portion and a tapered "B" portion as shown for the sidewalls 1132, 1142 in FIGS. 11C-11D. Finally, the inner front walls 1072, 1082 can be left out of this standard valley shield 1100 that is tailored for use with an inside corner junction of guttering 50.

Similarly, the "fixed" version of the dormer valley shield/controller 1200 will be curved as shown in FIGS. 12A-12B and the curvature will be fixed by making the front wall 1172/1182 as a single piece of material—effectively solidifying the pleats 1128, 1178, 1188 in the expanded form shown. Of course this would be simplified by eliminating the pleating to create a straight wall 1172 plus 1182. Such a design variation would also allow a continuous curve to be molded rather than a segmented one. The fixed controller 1200 will also have the sidewalls 1232, 1242 pre-formed with a tall "C" portion and a tapered "D" portion as shown for the sidewalls 1232, 1242 in FIG. 12B. Finally, the wings 1059, 1069 can be left out of this dormer valley shield 1200 that is tailored for use with a perpendicular junction with a straight section of guttering 1224.

Functional and Advantageous Aspects of the Flow Controller/Valley Shield

In the general discussion hereinbelow, reference numbers cited are generally only one of potentially several reference numbers applied to similar elements hereinabove, and should be understood as being representative of all such similar elements. For example, a reference to the flow controller (or valley shield) 1000 should also be treated as a generic reference to all of the flow controller/valley shields disclosed hereinabove with reference numbers 1000, 1100, and 1200. At the same time, any unique characteristics of an as-installed flow controller 1100, for example, should be understood as optionally present for a flow controller 1000, wherever it makes sense in the discussion.

Given the preferred installation of the controller 1000 as being under the second row of shingles from the bottom/front edge of the roof, the top surface 1020 is free of any obstructions all the way from the point in the valley 1125 above the controller 1000 downward to the front lip 60 of the guttering 50. This prevents buildup of debris into water dams. Thus there are no ridges or other obstructions for debris to be caught upon. Prior art shows numerous attempts to slow and change the course of water in a valley by placing an obstruction of some kind in its path. However, an obstruction alone placed in the path of water flow collects debris, a problem solved by the present invention.

The front wall 1052/1062 is provided with pleats 1028, 1058 and 1068 that allow for the installer to control the curvature of the surface of the flow controller 1000, while at the same time the front wall 1052/1062 creates a breakwall type of obstruction (a watershed or barrier) underneath the controller 1000 by being installed inside the front lip 60 of the gutter 50. The pleats being continuous (including, for example, overlapping panels as described hereinabove) ensure that the front wall 1052/1062 is watertight and will not leak, even without any other type of sealing. This is important, as water flowing under the controller 1000 will impact against this wall. However, this breakwall does not collect debris because it is beneath the controller 1000 while the debris has been separated and remains outside of the controller 1000 where it can be freely pushed off by water and wind, there being no obstruction to impede that.

The pleated design of the front wall 1052/1062 allows it to adapt to a guttering system which may have sections joining at an inside corner angle of more or less than 90 degrees.

The controller 1000 has sidewalls 1032, 1042 starting at the front outside termination points 1004*b*, 1006*b* of the front wall 1052/1062. The sidewalls 1032, 1042 extend back up the valley (e.g., 1125), paralleling the low point of the valley 1125, and preferably terminating such that sidewall end points SW1, SW2 are at the bottom edge of the second row of shingles (the upper area 1018 extending under the second row of shingles) guiding the water on to the top surface 1020. The sidewalls 1032, 1042 may initially be dimensioned higher than required, allowing the installer to trim them to fit different roof and gutter configurations. Some valleys 1125 may require that a portion of the sidewalls 1032 and 1042 be removed completely.

The sidewalls 1032 and 1042 have slits (vertical slot-like openings) 1034, extending from the planar stock material 1002 (top surface 1020) to the roof surface. The back edge of the slits 1034 may be extended inwardly, such as with a radius. In this way, water passage into the valley 1125 under/within the controller 1000 is encouraged by the shape of the debris-separating slit 1034 in a similar way to the shape of the slots 1024.

The top surface 1020 of the flow controller 1000, when installed properly (i.e., according to the invention), has a roughly concave shape which concentrates the water and debris into a narrowed flow. Ideally the low point of the top edge 1008 of the flow controller 1000 is smoothly attached directly on the lowest point(s) of the valley 1125, 1125', which allows for maximum utilization of kinetic energy that the water accumulates by flowing down the valley 1125, 1125' above to push debris off of the top surface 1020 of the flow controller 1000. Because of the concavity of the top surface 1020, debris is gathered in the path of maximum water flow, where it can effectively be ejected off of the controller 1000, and thus off the roof. This is more effective than water flowing in the valley 1125 itself because the top surface 1020 of the controller 1000 is generally more slippery than the valley 1125. It should be noted that the curvature of the surface 1020 is adjustable. The low point of the surface 1020 is thus adjustable in relation to the gutter 50.

The slots 1024 and sidewall slits 1034 both enable flow of water (separated from debris) through the shield 1000 into the roof valley 1125 below/within it, where it can freely stream downward and outward into the gutter 50, unobstructed by debris (which has been separated / filtered out by the slots 1024 and slits 1034), but prevented from splashing out beyond the gutter 50 by the breakwall 1052/1062 and/or 1072/1082. Thus the breakwall 1052/1062 prevents water from overshooting the gutter 50, but the trough effect created by the concavity of the top surface 1020 helps water and wind to push the debris off the front end 1010 of the valley shield 1000. The sidewalls 1032, 1042 perform a similar duty since they also have water/debris separating slits 1034. The slots 1024 in the top surface 1020 are oriented normal to the valley centerline 1003 to maximize their effectiveness in catching water and directing it down through the valley shield 1000.

The flow controller and valley debris shield 1000 (1100) can be easily used in laced shingle roof valleys 1125 and is easily adapted to a flashed roof valley 1125' that has a metal or similar flashing.

Wind, water and gravity are the forces that can be utilized.

The concave shape of the flow controller 1000 allows the centerline 1003 of the top 1020 to be lower than adjoining shingle edges to keep debris moving to the centerline 1003, which helps reduce the amount of debris that otherwise collects against the edge of the shingles along the valley 1125.

The slots 1024 (compare slots 24 and tabs 26") preferably have tab sides (compare 29") which form 90-degree angles with both the shield bottom surface 1022 (compare 78) and the tab 1026 (compare 26"), thereby maximizing the area and throughput of the slots 1024.

There is a benefit in the surface area of the tab 1026 being larger than the area of the hole (slot 1024) above it. The water flow in the valley 1125 has a given width dimension at any one time, and the area of the shield top surface 1020 being used is limited by the water flow width. Making the tabs 1026 longer effectively increases the water carrying surface area of the valley shield 1100, in effect suspending the water over the valley 1125, the suspension helping to get the water on top of the shield 1100 to be processed but not flooding the interior space within the shield 1100. By suspending the water it provides space for the tabs 1026 to function.

By extending tabs 1026 downwardly more rows of openings 1024 can be formed closer together thus increasing the surface area available to water. This is helpful since the sides of the valley 1125 confine the water flow. Many times the inventor has observed water in a roof valley, and seen that as the volume of rain increases, the depth increases faster than the width.

Comments Pertaining to the Prior Art

Some prior art patents have been referenced hereinabove: U.S. Pat. No. 1,986,383, (Usinger; 1935); U.S. Pat. No. 5,623,787 (Ali; 1997); and U.S. Pat. No. 6,883,760 (Seise, Jr.; 2005).

Usinger's miter can be viewed as simply a vertical extension of the outboard upstanding walls of the gutters to keep water running down the valley from overshooting the gutter. This is an early example of what is still commonly used as a solution to the overshooting problem, but problematically it increases the collection of debris in the gutter.

The Ali guard does not extend into (over) the gutter, and steep sided "mini-valleys" are created on each side of the guard. The combination of these steep sides with a mesh screen would appear to aggravate the problem of debris collection that it is supposed to remedy. Furthermore, it does not address the problem of water overshooting a gutter.

FIGS. 6, 7 and 8 of the Seise patent show a valley cover (210, 302) that is essentially flat as it crosses laterally over the valley. In contrast thereto, the flow controller of the present invention, as installed, is laterally concave. Furthermore, Seise's ledges (220, 218, etc.) provide less-sloped areas than the valley itself, thereby making debris accumulation in the valley more, rather than less likely. The perforated portion (222) that covers the gutter apparently lies approximately horizontally over the gutter, further allowing debris collection; and the flat metal portions (e.g., 206, 208, 302) that extend to the bull-nose edge (e.g., 304) still allow water to overshoot the gutter when rainfall is heavy. Even further, Seise's "tunneled" perforations are like a cheese grater and therefore catch and clog with debris much more than the slots and slits described according to the present invention. These last problems have already been noted hereinabove for gutter covers like those of Seise (e.g., 14 in his FIG. 1). Another difference is noted in that Seise's valley cover is not lifted at its longitudinal side edges by progressively tapered sidewalls such as those illustrated by the "B" portion of the sidewall 1142 in FIG. 11D according to the present invention. Advantages of the inventive design are described hereinabove, and include, for example, accommodating water flow under the valley shield 1100 that progressively increases in volume as the valley shield 1100 extends down the valley 1125.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A flow controller for controlling flow of water from a roof valley into guttering that is mounted at the front edge of a roof, the flow controller comprising:

a generally rectangular, generally planar piece of stock material defining a top portion of the flow controller, the top portion having: two longitudinally extending side edges and a longitudinal axis therebetween, a back end edge and a front end edge, a top surface and a bottom surface, and an area of the top portion that is perforated with a plurality of open holes for allowing rainwater therethrough;

two sidewalls extending downward from the bottom surface of the top portion and comprising: a first sidewall extending downward along a portion of a first of the two side edges of the flow controller; and a second sidewall extending downward along a portion of a second of the two side edges of the flow controller;

a lateral curve in the top portion wherein the top surface is depressed along the longitudinal axis to make it lower than the side edges; and a front wall that extends downward from the bottom surface of the top portion along the front end edge; wherein:

the sidewalls decrease in height back from the front end edge to zero height where there is no sidewall near the back end edge;

thereby adapting the flow controller for securing substantially the entire back end edge in direct contact with the roof.

2. The flow controller of claim 1, wherein the open holes further comprise:

lateral slots that are spaced apart in substantially parallel, laterally-extending rows.

3. The flow controller of claim 2, wherein:

at least some of the slots each comprise an aperture through the top portion at an outboard edge of a downwardly ramped tab.

4. The flow controller of claim 3, wherein:

at least some of the tabs each comprise a breakwall ridge extending downward at an end of the tab.

5. The flow controller of claim 1, wherein:

each of the sidewalls is segmented by a plurality of vertical slits for allowing water to pass from outside of the flow controller to underneath the top portion thereof.

6. The flow controller of claim 1, wherein:

the sidewalls are a first height for a frontmost portion of their longitudinal length; the frontmost portion's length corresponding to the longitudinal distance that the frontmost sidewall portion would extend, after being installed, from an outer upstanding wall of the gutter to the front edge of the roof; and the height of the sidewalls extending back from the frontmost portion decreases from a second height that is less than the first height, to zero near the back end edge where there is no sidewall.

7. The flow controller of claim 1, further comprising:

at least one vertical overlap portion in the front wall, wherein the overlap portion comprises a portion of the front wall that is expandable substantially laterally or substantially in the plane of a portion of the front wall if that portion is not extending substantially laterally.

8. The flow controller of claim 7, further comprising:

a first overlap portion substantially at a longitudinal axis of the flow controller disposed approximately midway between the two side edges of the flow controller;

a second overlap portion disposed substantially on a line parallel to the longitudinal axis and approximately midway between the longitudinal axis and one of the side edges; and a third overlap portion disposed substantially on a line parallel to the longitudinal axis and approximately midway between the longitudinal axis and the other one of the side edges.

9. The flow controller of claim 1, wherein the front wall comprises:

first and second front wall portions; the first front wall portion extending downward along a first portion of the front end edge; and the second front wall portion extending downward along a second portion of the front end edge; wherein:

the front end edge is generally V-shaped, such that the first and second portions of the front end edge meet at an angle which substantially matches a nominal 90-degree angle inside corner formed by two roof front edges in front of a roof valley.

10. The flow controller of claim 9, further comprising:

an inner wall that extends downward from the bottom surface of the top portion;

wherein the inner wall:

extends laterally between the two side edges; and is disposed substantially at a right angle relative to the longitudinal axis.

11. The flow controller of claim 10, further comprising:

at least one vertical overlap portion in the inner wall, wherein the overlap portion comprises a portion of the inner wall that is expandable substantially laterally.

12. The flow controller of claim 11, further comprising:

a first overlap portion substantially at a longitudinal axis of the flow controller disposed approximately midway between the two side edges of the flow controller;

a second overlap portion disposed substantially on a line parallel to the longitudinal axis and approximately midway between the longitudinal axis and one of the side edges; and a third overlap portion disposed substantially on a line parallel to the longitudinal axis and approximately midway between the longitudinal axis and the other one of the side edges.

13. The flow controller of claim 10, further comprising:

a scored, perforated, or otherwise weakened line extending laterally and disposed in front of the inner wall, thereby easing removal of wing portions of the flow controller to make the inner wall a front wall.

14. A flow control method of controlling flow of rainwater from a sloped roof down into guttering at the roofs front edge, the flow control method comprising the steps of:

providing a generally rectangular, generally planar piece of stock material defining a top portion of a flow controller having: two longitudinally extending side edges and a longitudinal axis therebetween, a back end edge and a front end edge, a top surface and a bottom surface, an area of the top portion that is perforated with a plurality of open holes for allowing rainwater therethrough, and a front wall that extends downward from the bottom surface at the front end edge;

installing the flow controller according to the steps of:

extending the side edges of the top portion up the roof surface;

securing substantially all of the back end edge in direct contact with the roof;

extending the front wall down into the guttering;

providing sidewalls extending downward from the side edges of the top portion for raising the top portion above the roof surfaces; and trimming or otherwise adjusting the height of the sidewalls such that they are a first height for a frontmost portion of their longitudinal length; the frontmost portion's length corresponding to the longitudinal distance that the frontmost sidewall portion would extend, after being installed, from an outer upstanding wall of the gutter to the front edge of the roof; and such that the height of the sidewalls extending back from the frontmost portion decreases from a second height that is less than the first height, to zero near the back end edge where there is no sidewall;

depressing the top portion as needed along the longitudinal axis to make it lower than the side edges for at least a portion of the top portion extending back from the front end edge; and attaching the front wall inside of an outward upstanding wall of the guttering;

thereby providing a flow controller with a back end edge against the roof for directing water flow onto the top portion, which has a laterally concave top surface for concentrating the water flow and debris along the longitudinal axis to maximize effectiveness in ejecting debris off of the roof while separating the water from the debris, the water separately passing through the open holes to flow under the top portion until stopped by the front wall and diverted down into the guttering rather than flowing over the top of the guttering.

15. The flow control method of claim 14, further comprising the step of:

providing vertical slits in the sidewalls for allowing water, separated from debris, to pass from beside the flow controller to underneath the top portion.

16. The flow control method of claim 14, further comprising the step of:

providing overlap portions in the front wall for enabling the front wall to expand like a fan as the top portion is depressed, thereby maintaining the front wall as a substantially watertight breakwall even when the top portion is deformed.

17. The flow control method of claim 14, further comprising the steps of:

installing the flow controller along a valley formed by two adjoining roof surfaces such that the front wall extends down into an inside corner of the guttering; and providing a substantially right angled V-shaped front end edge and a corresponding front wall that fits the inside corner of the guttering.

18. The flow control method of claim 17, further comprising the steps of:

providing a second front wall extending downward from the bottom surface of the top portion in a straight lateral line normal to the longitudinal axis and rearward of the V-shaped first front wall to make a double-walled flow controller that can still be installed along a valley formed by two adjoining roof surfaces; and for installing the double-walled flow controller on a portion of the roof that has a laterally straight front edge and correspondingly straight guttering: cutting off, breaking off, or otherwise removing the first front wall and the planar stock material between it and the second front wall such that the second front wall is the front wall that extends down into the guttering and is attached thereto.

19. The flow control method of claim 18, further comprising the step of:

providing a kit that comprises the flow controller physical elements provided in the flow control method of claim 20, plus instructions that explain method steps for installing the flow controller according to the flow control method of claim 20.

20. The flow control method of claim 19, further comprising the steps of:

providing the kit with physical elements comprising sidewalls with vertical slits therethrough, the sidewalls extending downward from the bottom surface of the top portion along the side edges of the top portion; and including in the instructions of the kit a step of trimming or otherwise adjusting the height of the sidewalls such that:

they are a first height for a frontmost portion of their longitudinal length; the frontmost portion's length corresponding to the longitudinal distance that the frontmost sidewall portion would extend, after being installed, from an outer upstanding wall of the gutter to the front edge of the roof; and the height of the sidewalls extending back from the frontmost portion decreases from a second height that is less than the first height, to zero near the back end edge where there is no sidewall.

21. A flow controller for controlling flow of water from a roof valley into guttering that is mounted at the front edge of a roof, the flow controller comprising:

a generally rectangular, generally planar piece of stock material defining a top portion of the flow controller, the top portion having: two longitudinally extending side edges and a longitudinal axis therebetween, a back end edge and a front end edge, a top surface and a bottom surface, and an area of the top portion that is perforated with a plurality of open holes for allowing rainwater therethrough;

two sidewalls extending downward from the bottom surface of the top portion and comprising: a first sidewall extending downward along a portion of a first of the two side edges of the flow controller; and a second sidewall extending downward along a portion of a second of the two side edges of the flow controller;

a lateral curve in the top portion wherein the top surface is depressed along the longitudinal axis to make it lower than the side edges;

a front wall that extends downward from the bottom surface of the top portion along the front end edge;

at least one vertical overlap portion in the front wall, wherein the overlap portion comprises a portion of the front wall that is expandable substantially laterally or substantially in the plane of a portion of the front wall if that portion is not extending substantially laterally.

a first overlap portion substantially at a longitudinal axis of the flow controller disposed approximately midway between the two side edges of the flow controller;

a second overlap portion disposed substantially on a line parallel to the longitudinal axis and approximately midway between the longitudinal axis and one of the side edges; and a third overlap portion disposed substantially on a line parallel to the longitudinal axis and approximately midway between the longitudinal axis and the other one of the side edges.

* * * * *